US012656086B2

(12) United States Patent
Cole et al.

(10) Patent No.: US 12,656,086 B2
(45) **Date of Patent: *Jun. 16, 2026**

(54) MODULAR ARMOR SUPPLEMENT APPARATUS AND SYSTEM WITH SILENT FASTENERS AND ADJUSTABILITY

(71) Applicant: FirstSpear Technology Group, LLC, Fenton, MO (US)

(72) Inventors: Michael E. Cole, Ste. Genevieve, MO (US); Jon Laplume, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/816,926

(22) Filed: Aug. 27, 2024

(65) Prior Publication Data

US 2024/0418481 A1 Dec. 19, 2024

Related U.S. Application Data

(62) Division of application No. 18/109,694, filed on Feb. 14, 2023, now Pat. No. 12,072,168, which is a division of application No. 16/404,375, filed on May 6, 2019, now Pat. No. 11,578,948, which is a division of application No. 14/152,573, filed on Jan. 10, 2014, now Pat. No. 10,281,240.

(60) Provisional application No. 61/752,066, filed on Jan. 14, 2013.

(51) Int. Cl.
*F41H 1/02* (2006.01)

(52) U.S. Cl.
CPC ..... *F41H 1/02* (2013.01); *Y10T 24/34* (2015.01)

(58) Field of Classification Search
CPC ..... F41H 1/02; Y10T 24/34; A41D 27/201
See application file for complete search history.

(56) References Cited

U.S. PATENT DOCUMENTS

| | | | | |
|---|---|---|---|---|
| 4,236,658 | A * | 12/1980 | Kallman | A45F 5/00 224/908 |
| 4,282,657 | A | 8/1981 | Antonious | |
| 4,486,965 | A | 12/1984 | Friton | |
| 4,673,070 | A | 6/1987 | Ambal | |
| RE32,585 | E | 2/1988 | Antonious | |
| 4,776,068 | A | 10/1988 | Smirlock et al. | |
| 5,060,314 | A * | 10/1991 | Lewis | A62B 17/003 2/2.5 |
| 5,724,707 | A | 3/1998 | Kirk et al. | |
| 5,815,843 | A | 10/1998 | Brillhart, III et al. | |
| 7,047,570 | B2 | 5/2006 | Johnson | |
| 7,076,806 | B1 * | 7/2006 | Van Winkle | F41H 1/02 2/2.5 |
| 7,080,430 | B2 | 7/2006 | Wemmer | |

(Continued)

*Primary Examiner* — Alissa L Hoey
(74) *Attorney, Agent, or Firm* — Matthews Edwards LLC

(57) ABSTRACT

A silent fastener for connecting a first element to a second element utilizes a foldable or bendable element attached to the first element and extending to the second element, the second element having at least one slit connecting to a flat internal cavity, and a first tuck tab connected to the foldable or bendable element and receivable in the cavity with the a predetermined region of the first element in overlaying relation to the first tuck tab, and a second tuck tab connected to the foldable or bendable element and receivable in another portion of the cavity extending away from the predetermined region of the first element, connecting the first and second elements.

20 Claims, 24 Drawing Sheets

(56) References Cited

U.S. PATENT DOCUMENTS

| | | | | |
|---|---|---|---|---|
| 7,490,358 | B1 | 2/2009 | Beck | |
| 7,526,842 | B2 | 5/2009 | Wemmer | |
| 7,694,862 | B2 | 4/2010 | Bergeron | |
| 7,814,567 | B2 | 10/2010 | Dovner et al. | |
| 7,979,917 | B2 | 7/2011 | Osborne | |
| 7,987,523 | B2 | 8/2011 | Cole et al. | |
| 8,002,159 | B2 | 8/2011 | Cragg | |
| 8,111,582 | B2 * | 2/2012 | Beck | F41H 1/02 367/906 |
| 8,201,271 | B2 | 6/2012 | Dennis | |
| 8,370,962 | B2 | 2/2013 | McBride et al. | |
| 8,505,113 | B2 | 8/2013 | Crye et al. | |
| 8,533,871 | B2 * | 9/2013 | Fiegener | A63B 71/12 2/113 |
| 8,713,764 | B1 | 5/2014 | Rittenhouse et al. | |
| 8,898,814 | B2 | 12/2014 | Storms, Jr. et al. | |
| 9,144,294 | B2 | 9/2015 | Gregory et al. | |
| 9,194,660 | B2 * | 11/2015 | Crye | F41H 1/02 |
| 9,565,922 | B2 * | 2/2017 | Cole | A45F 5/021 |
| 10,264,874 | B2 * | 4/2019 | Becker | A45F 3/14 |
| 10,281,240 | B2 | 5/2019 | Cole et al. | |
| 11,578,948 | B2 | 2/2023 | Cole et al. | |
| 11,661,254 | B1 * | 5/2023 | Storms, Jr. | B65D 63/1027 24/712 |
| 2005/0015069 | A1 | 1/2005 | Hamilton et al. | |
| 2007/0158380 | A1 * | 7/2007 | Calkin | A41D 13/0012 224/675 |
| 2008/0257922 | A1 * | 10/2008 | Cragg | A45F 5/02 224/269 |
| 2009/0013506 | A1 | 1/2009 | Mizuhara et al. | |
| 2009/0307878 | A1 | 12/2009 | Kadas | |
| 2011/0083240 | A1 * | 4/2011 | Crye | A42B 3/085 2/2.5 |
| 2011/0191933 | A1 * | 8/2011 | Gregory | A45F 5/02 2/69 |
| 2012/0174286 | A1 * | 7/2012 | McBride | F41H 1/02 2/102 |
| 2013/0126566 | A1 * | 5/2013 | Seuk | A45F 5/00 224/223 |
| 2014/0090140 | A1 | 4/2014 | Craig et al. | |
| 2015/0096111 | A1 * | 4/2015 | LeMarbe | F41H 1/02 24/3.13 |
| 2015/0211829 | A1 * | 7/2015 | Cole | F41H 1/02 2/463 |

* cited by examiner

MODULAR ARMOR SUPPLEMENT APPARATUS AND SYSTEM WITH SILENT FASTENERS AND ADJUSTABILITY

This application is a division of co-pending U.S. patent application Ser. No. 18/109,694, filed Feb. 14, 2023, which is a division of U.S. patent application Ser. No. 16/404,375, filed May 6, 2019, now U.S. Pat. No. 11,578,948, dated Feb. 14, 2023, which is a division of U.S. patent application Ser. No. 14/152,573, filed Jan. 10, 2014, now U.S. Pat. No. 10,281,240, dated May 7, 2019, which application claims the benefit of U.S. Provisional Application No. 61/752,066, filed Jan. 14, 2013.

TECHNICAL FIELD

The present invention relates generally to a modular armor supplement system and manner of assembly and adjustment, and more particularly, that includes ballistic throat and neck protectors cooperatively connectable for providing an adjustable neck opening, which can be worn alone, or incorporated with semi-rigid over shoulder straps connecting upper chest and back panels connectable with an accompanying armored vest or plate carrier worn over the torso, which shoulder straps are additionally connectable to optional deltoid protectors, all of which enable rapid donning and doffing the accompanying vest or carrier, over and separately of the supplement apparatus and system if desired. The apparatus and system can additionally incorporate several embodiments of silent fasteners for facilitating rapid donning and doffing, that advantageously provide sufficient holding power yet can be connected, adjusted, and disconnected substantially silently, that is, without the noise associated with connectors such as snaps, hook and loop fasteners, and the like.

BACKGROUND ART

The disclosures of co-pending U.S. patent application Ser. No. 18/109,694, filed Feb. 14, 2023, U.S. patent application Ser. No. 16/404,375, filed May 6, 2019, now U.S. Pat. No. 11,578,948, dated Feb. 14, 2023, U.S. patent application Ser. No. 14/152,573, filed Jan. 10, 2014, now U.S. Pat. No. 10,281,240, dated May 7, 2019, and U.S. Provisional Application No. 61/752,066, filed Jan. 14, 2013, are incorporated herein by reference in their entireties.

Modular armor systems for use in tactical and military operations, including garments, namely ballistic vests and armor plate carriers, are well known. Such systems, particularly the vests and carriers, have apparatus for assembling and securely holding the garment on or about the user's body. Older known ballistic vests in particular often have complex systems for placing and assembling the vest about the body, herein also referred to as doffing the vest or garment, typically utilizing a complex system of belts and straps that take significant time and familiarity to assemble and adjust, and for removing or doffing it. More recently, apparatus and systems for rapid removal of garments such as ballistic vests in emergency situations such as combat to enable inspecting and treating injuries to the wearer's body, and to facilitate escape from dangerous situations such as immersion in water, have been developed.

Reference in this regard, the ballistic vest disclosed in U.S. Pat. No. 7,047,570, which discloses front and rear portions that can separate completely from one another, while a waist belt and cummerbund of the vest have an end that separates from at least one of the front and rear portions.

This vest uses a complex system of belting and straps for normal donning and doffing, and a rapid release system which utilizes a flexible retainer including a cable that can be quickly pulled to break the vest into pieces for removal. In emergency situations, it is necessary to remove the vest very rapidly, e.g., when sinking or immersed in water, or in the case of a severe injury or suspected injury to the protected region of the body.

As other known ballistic vests, reference U.S. Pat. No. 7,979,917, which discloses a rear break away feature; U.S. Pat. No. 7,987,523 which discloses a quick release garment which is also a ballistic vest, that utilizes a flexible retainer similar to that of U.S. Pat. Nos. 7,047,570; and 8,056,196 which discloses a quick release fitting having utility for use in garments such as ballistic vests and the like.

It can be observed that the known carriers and vests such as those referenced above, do not provide protection for the neck and throat regions of the body. When such protection is desired, e.g., for various military or tactical operations, supplemental throat and neck protectors can be added to the know systems. However, a disadvantage with the presently known supplemental protector apparatus, is they attach to the vest or carrier in a manner which limits or reduces the size of the neck opening or space. This can interfere with microphones and other communications gear that may be worn at the same time. The known supplemental systems also reduce the ability to rapidly remove or doff the vest or carrier, thereby reducing or even negating the benefit of the rapid release system.

Components of tactical vests, plate carriers, belts, chest rigs, and the like, typically used in military and law enforcement activities, are typically connected or joined together using well known fasteners and closures, such as mechanical clasps, snaps, buckles, ladder locks, and hook and loop systems. Such apparatus and garments are often outfitted with pouches, pockets, and other holders, for carrying a variety of objects, particularly, ammunition, communications and other electronic devices, batteries, food, and medical supplies. Such pouches, pockets and other holders typically also include well known, secure fasteners and closures, such as mechanical clasps, snaps, buckles, ladder locks, and hook and loop fasteners. However, a shortcoming of many of the various known fasteners and closures, sometimes herein referred to singularly as "fasteners" is that, at least when opened, a distinct sound is emitted. For mechanical fasteners, it is typically a brief mechanical clicking or sliding sound. For hook and look fasteners, it is typically a protracted tearing sound. As a consequence, a wearer's secret or concealed location may be disclosed by use of the fastener. However, adjusting fit, or accessing items secured by such fasteners may be necessary or desired. Buttons are known silent fasteners, but are difficult to manipulate when wherein gloves, and can be particularly difficult to locate and unfasten under emergency and exigent circumstances. Buttons are also easily broken off and lost, and can concentrate stress on an associated garment or other item when heavily loaded.

Thus, what is sought is a manner for providing armored throat and neck protection, alone or as a supplement to an armored vest or carrier system, and silent fastening and connecting apparatus, which overcome one or more of the disadvantages and shortcomings of known apparatus and systems.

SUMMARY OF THE INVENTION

What is disclosed is a modular armor system and apparatus, usable alone or as a supplement to an armored vest or carrier system, which overcomes one or more of the disadvantages and shortcomings of known apparatus and systems, set forth above, including allowing donning and doffing the vest and/or carrier separately of the supplement system and apparatus, and fasteners and connectors that enable silent connection, disconnection, adjustment, opening, and closure, of associated components.

According to a preferred aspect of the invention, the modular supplement system and apparatus utilizes a throat protector and neck protector, each configured to carry armor, and which is shaped or shapable to have a outer convex side and an opposite inner concave side. The throat and neck protectors are connectable in generally end to end relation with the concave sides bounding and defining a neck opening having a size and shape for receiving a person's neck, with the convex sides facing outward, providing front, rear and side armored protection for the wearer's throat and neck. The armor components of the protectors can comprise a well know commercially available soft armor such as a woven aramid fiber, and/or a plate armor, conventionally carried e.g., in zippered compartments in the protectors, used for military, police, and security, as desired or required for a particular application.

According to another preferred aspect, the supplement system and apparatus includes silent connecting elements configured to connect the ends of the throat and neck protectors together in a manner for holding them in place about the person's neck, to prevent release or disconnection under forces anticipated to be exerted thereagainst during normal use, including the weight of the protector, and forces exerted by body movements, and when the protectors include armor plate or plates. The silent connecting elements are sufficiently large and silently manually movable in a manner to allow adjusting a sectional or diametrical extent of the neck opening, for example, for comfort, different neck sizes, and accommodating gear such as helmets and/or radio headphones, microphones, etc.

As still another preferred aspect of the invention, one or both of the protectors can detachably connect to aspects of a vest or carrier, worn at the same time, and, as a non-limiting example the modular system and apparatus can include armored upper chest and back protectors connected to the throat and neck protectors, for instance, in a depending manner, e.g. connected via suitable straps or the like. The upper chest and back protectors are preferably additionally connected together by adjustable shoulder straps separate of shoulder straps connecting front and rear sections of an accompanying vest and/or carrier, preferably, worn above the straps of the supplement system. These shoulder straps can also carry optional deltoid protectors of the system.

According to a preferred manner of use, the shoulder straps of the modular supplement system and apparatus of the invention are configured to allow separately donning and doffing the vest and/or carrier, the shoulder straps of the supplement system being donned first, and the shoulder straps of the latter donned second.

Aspects of the modular system not anticipated to require adjustment, removal, or disconnection when doffing the system, or when silence is not required can be connected using known fasteners such as hook and loop fasteners and the like.

As another preferred aspect of the invention, connecting elements are used to adjustably connect the throat and neck protectors. The silent connecting elements are of a frictional or magnetic type, and can be configured to provide multiple relative positions to enable variability of the size of neck opening between a maximum value and a minimum value, including optionally infinite positioning between those positions, if desired. The connecting elements can also be quickly and easily connected and disconnected, including silently, for fast donning and doffing, independently of a vest and/or carrier.

As another preferred aspect of the invention, the connecting elements comprise a tuck tab or tabs, which essentially comprise elongate or tongue shaped, generally stiff or rigid members on or connected to at least one of the ends of at least one of the protectors, and a sleeve or sleeves in or adjacent to an end of another of the protectors, each sleeve comprising an external slit or slits in connection with an internal cavity or cavities, configured for cooperatively receiving and holding the tuck tab at a selectable longitudinal position therein. The tuck tab and internal surfaces of the sleeve have a relatively high combined friction coefficient, and for this purpose can comprise, but is not limited to, a course woven nylon or pile fabric, non-slip composition, or the like which will resist longitudinal movement of the tuck tab within the sleeve under normal anticipated applied forces. The sleeve is additionally preferably constructed to exert a compressive force against the tuck tab when received therein, to enhance the frictional engagement, for retaining the tuck tab at the inserted position within the sleeve.

More particularly, at least one surface within the internal cavity of the sleeve is positioned to be located in surface to surface engagement with the tuck tab surface or surfaces, and can comprise, as a non-limiting example, a coarse woven nylon fabric, such as a type typically used for covering ballistic vests and armor carriers, to facilitate the engagement. The extent of the rigidity of the tuck tab is sufficient to allow it to be inserted by exerting a manual force to push through the slit into and through the internal cavity to a desired extent without significantly deforming, e.g. bending, and the receiving cavity is constructed to allow the insertion to a desired extent.

To allow adjustment, the tuck tabs are each relatively long, and the sleeve is preferably configured to be silently deformable in a convenient and easy manner, such as by manually pinching between fingers, to reduce the compressive force, to allow moving the tuck tabs on either side longitudinally sufficiently for positioning the throat protector at a desired location. The deformation can also be used to allow more easily and substantially silently removing the tuck tab. As a non-limiting example, the exterior of the sleeve can comprise a taught fabric covering, that is manually manipulatable or pinchable, to open a slight amount in a "fish mouth" shape so as to be enlarged in width (its narrowest dimension) to facilitate the insertion of the tuck tab and also its movement within the sleeve. Then, when the fabric is released the slit and cavity of the sleeve will automatically flatten to a normal or free state condition to exert the compressive force against the tuck tab, which combined with the frictional contact, will be sufficient to retain the tuck tab in position for holding the protectors together about a user's neck.

As noted above, the throat and neck protectors are configured to carry ballistic armored components which can comprise a lighter fabric ballistic protective material, and/or a heavier, rigid plate material, e.g., plate armor covered by one or more outer or covering layers of a fabric or fabrics, and in either instance this construction having sufficient overall stiffness for at least contributing to the tautness of the sleeve fabric and biasing toward the flattened condition and against the tuck tab when received in the sleeve.

As an additional capability, in an emergency situation the frictional forces holding the tuck tab can be capable of being manually overcome by exertion of a relatively high longitudinal force if rapid removal or a break-away capability is required.

As another preferred aspect of the invention, the principles of construction and operation of the silent connectors can be utilized for other applications, such as for fastening or closing pouches commonly carried on components of tactical kits such as vests, carriers, belts and the like. The silent fastener includes a generally flat, first tuck tab having a connected end flexibly connected to a first element of the pouch, and an opposite free end; a generally rigid, generally flat, second tuck tab having a connected end flexibly connected to the first element in generally parallel relation to the connected end of the first tuck tab, such that the tuck tabs can be relatively moved about the connected ends between positions extending generally in opposite directions, and alternatively at positions at a small acute angle to each other forming a narrow V-shape when viewed toward a side of the tuck tabs. The fastener includes at least one slit in an outer surface of a flexible second element of the pouch, configured to receive the free ends of the tuck tabs, the at least one slit connecting with internal cavities within first and second portions of the second element sufficiently large for receiving the tuck tabs, respectively, the internal cavities being bounded and defined by opposing internal surfaces configured and operable to engage and retain the tuck tabs within the cavity when the first and second portions extend in generally opposite directions. The internal cavities are configured to allow substantially silent insertion and removal of the tuck tabs when the first and second portions are in a generally overlaying relation with the second element flexed in a V-shape or U-shape.

According to another preferred aspect of the invention, the tuck tabs are located on a strap or web of the first element, which strap or web is tensionable with the tuck tabs retained in the internal cavities and second element in the operational configuration so as to be held in generally overlaying relation to one of the first portion or the second portion of the second element.

DESCRIPTION OF PREFERRED EMBODIMENTS OF THE INVENTION

Figure 1:
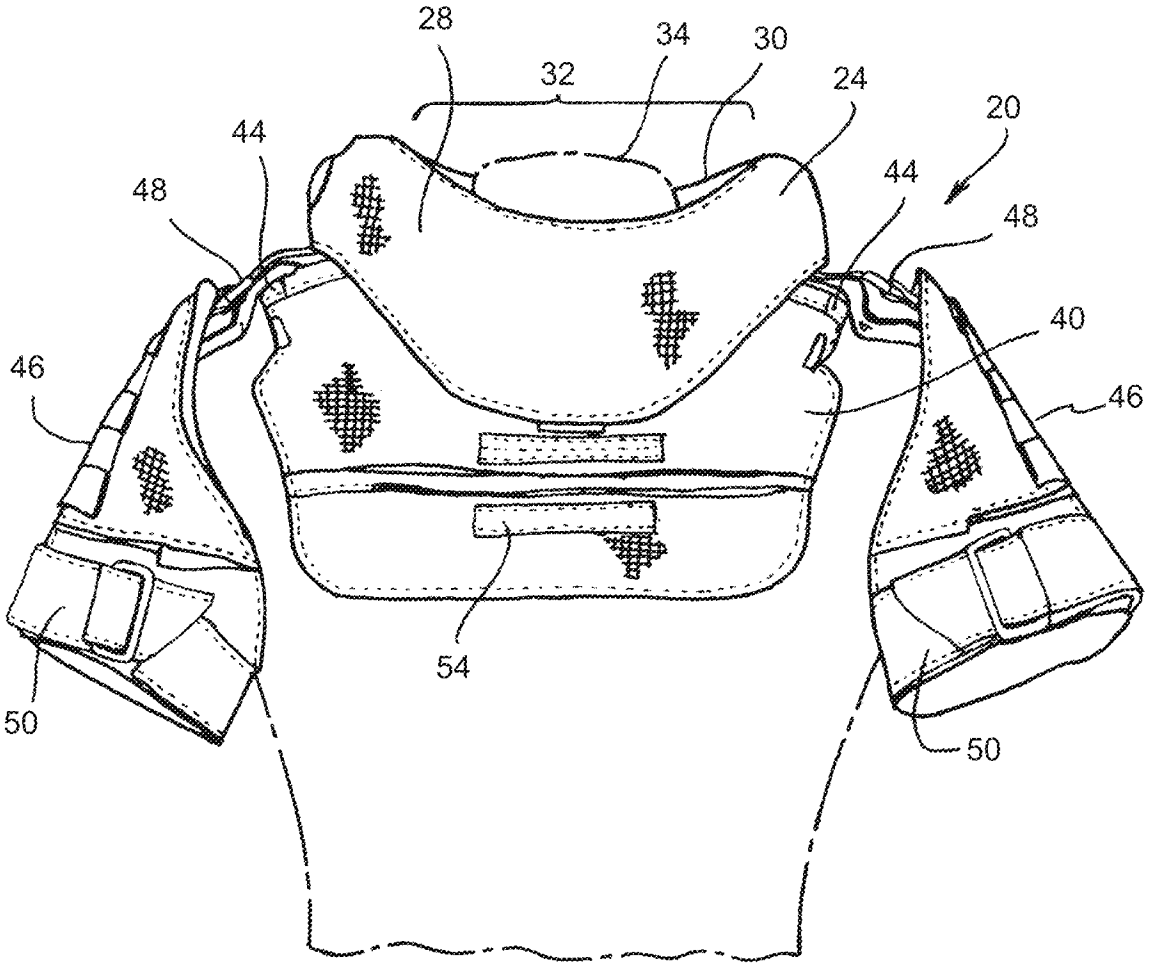
FIG. 1 is a front perspective view of an embodiment of a modular armor supplement apparatus and system of the invention.
Figure 2:
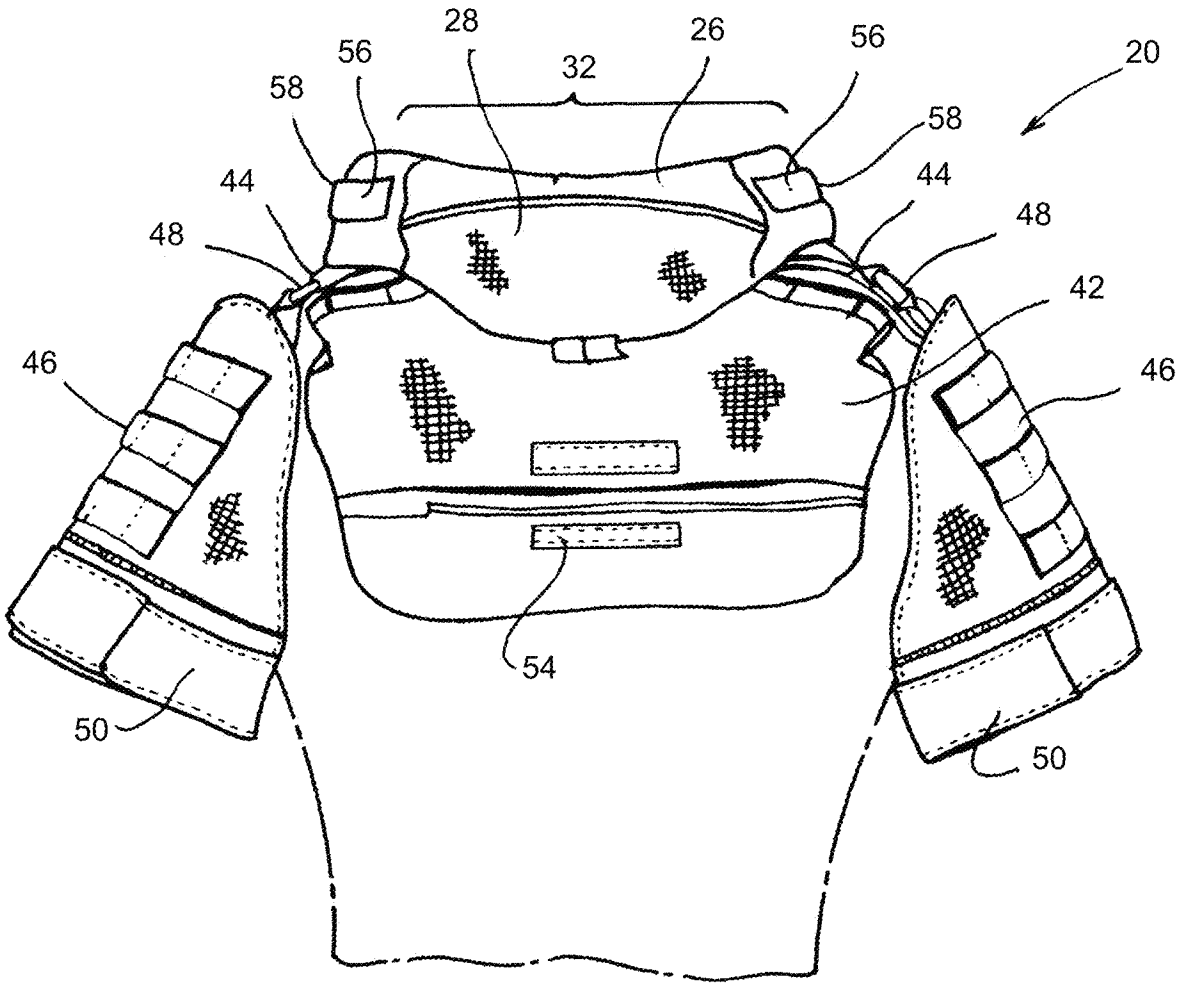
FIG. 2 is a rear perspective view of the embodiment of the modular armor supplement apparatus and system shown in FIG. 1.
Figure 3:
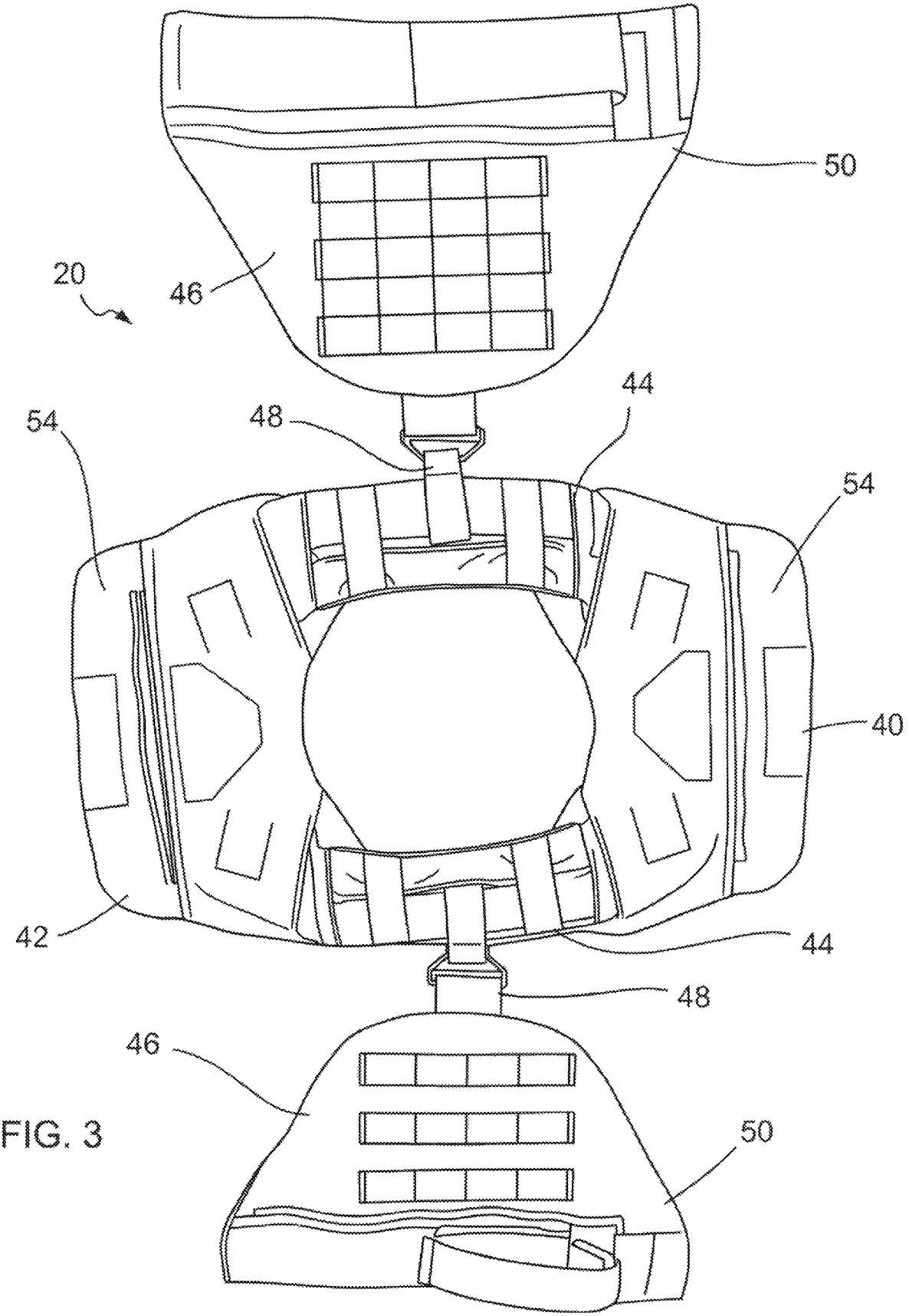
FIG. 3 is a top view of aspects of the modular armor supplement apparatus and system shown in FIG. 1, including upper chest and back protectors and deltoid protectors connected thereto via shoulder straps.
Figure 4:
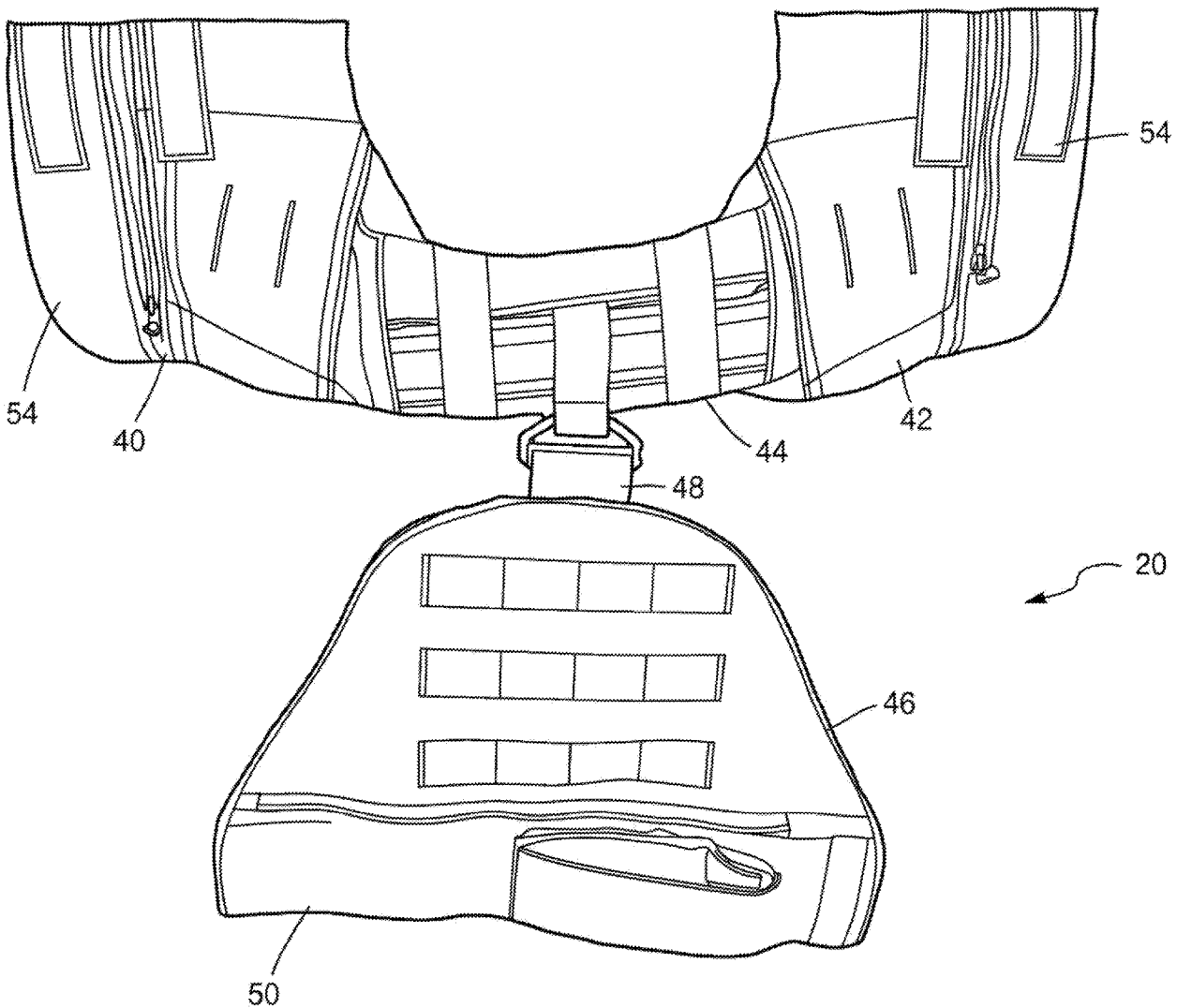
FIG. 4 is an enlarged fragmentary top view of aspects of the modular armor supplement apparatus and system shown in FIG. 3, showing connection of a shoulder strap to the upper chest and back protectors, and connection of a deltoid protector to the shoulder strap.
Figure 5:
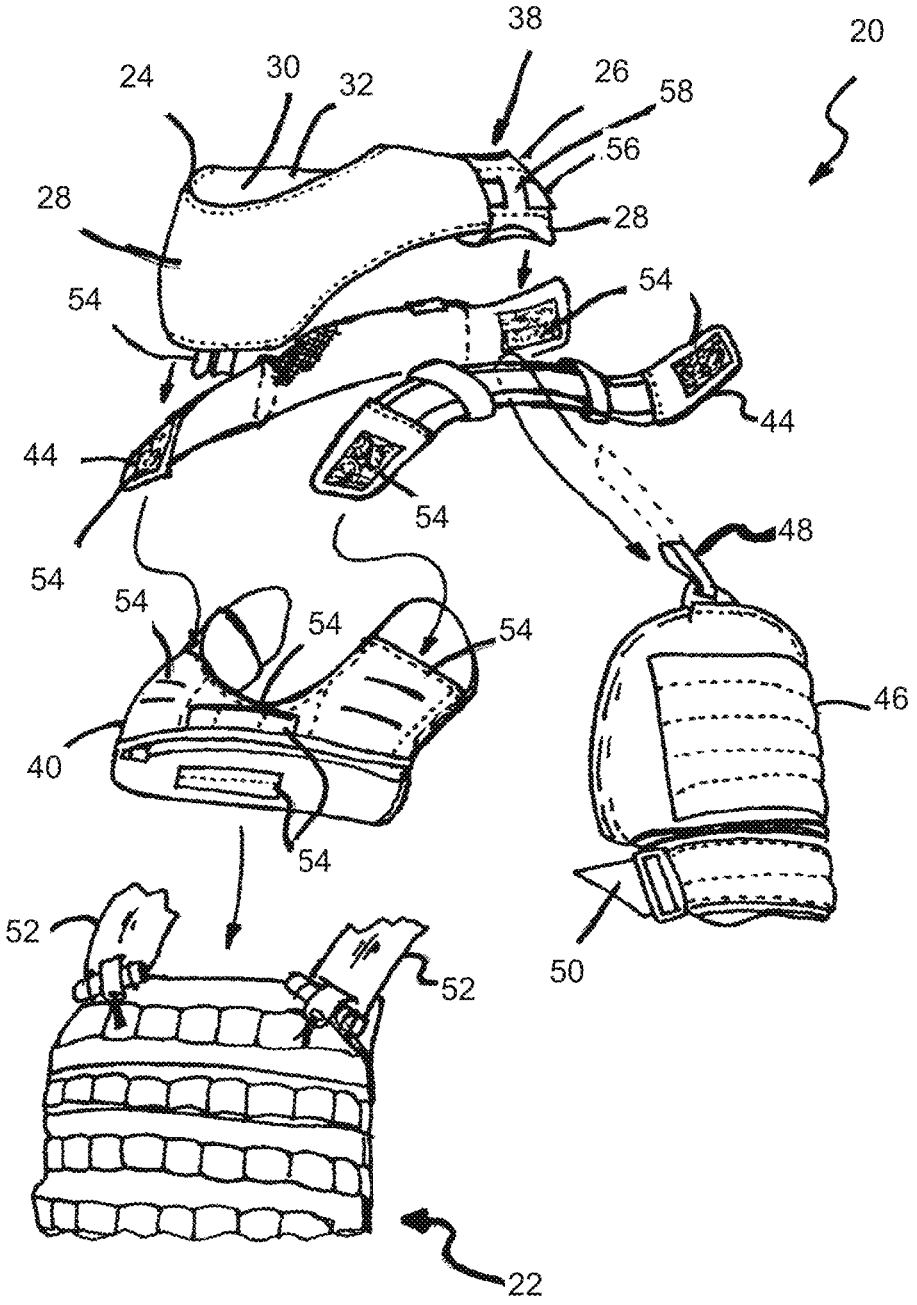
FIG. 5 is an exploded perspective view of the embodiment of the modular armor supplement apparatus and system shown in FIG. 1, illustrating with arrows connection of the components thereof, and also showing with an arrow connection to a front carrier of an armored vest.
Figure 6:
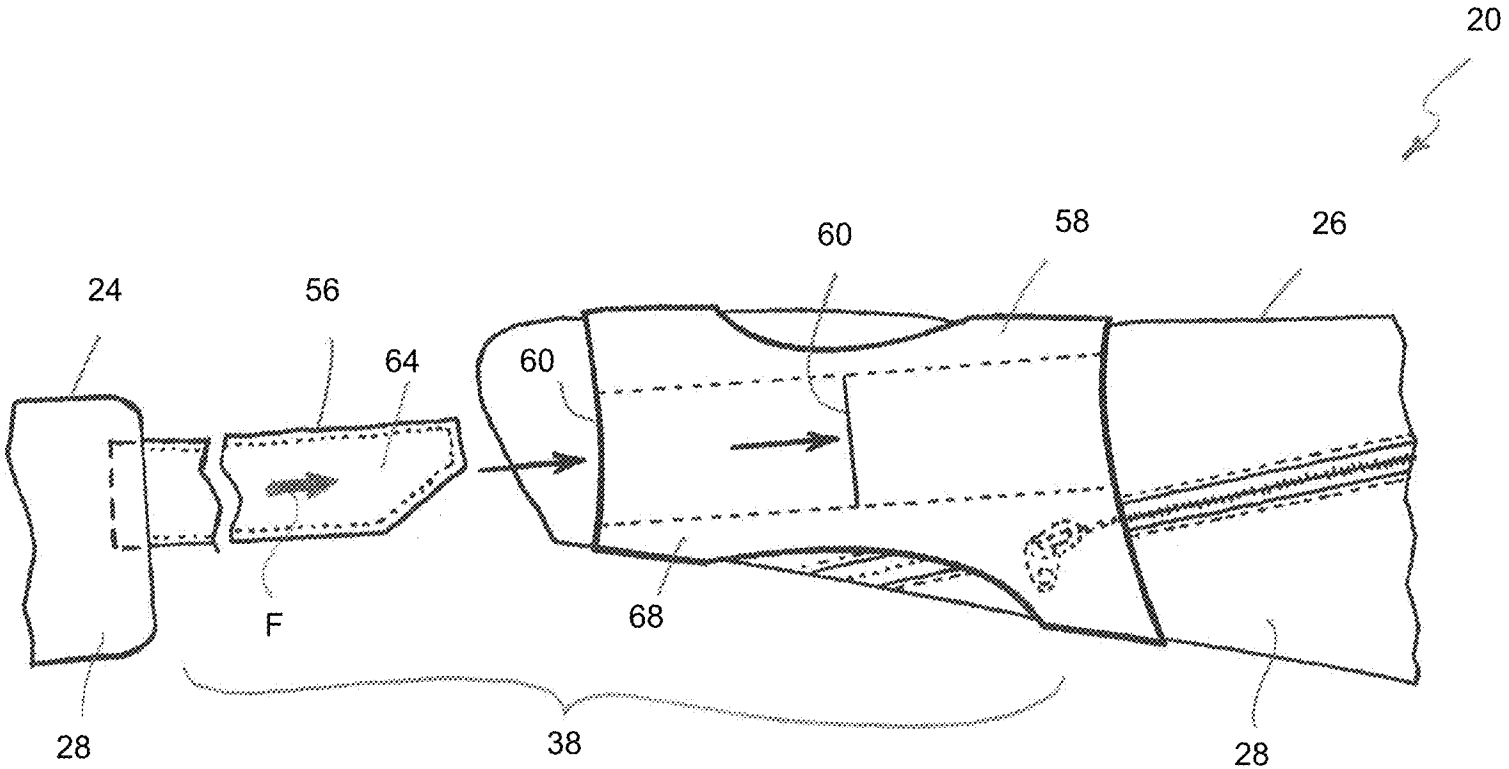
FIG. 6 is an enlarged view of aspects of a throat protector and a neck protector of the system of the invention, showing connecting elements including an elongate tuck tab on an end of one of the protectors, selectably insertable into one of two sleeves on another of the protectors as denoted by arrows for frictional retention therein for connecting the protectors.
Figure 7:
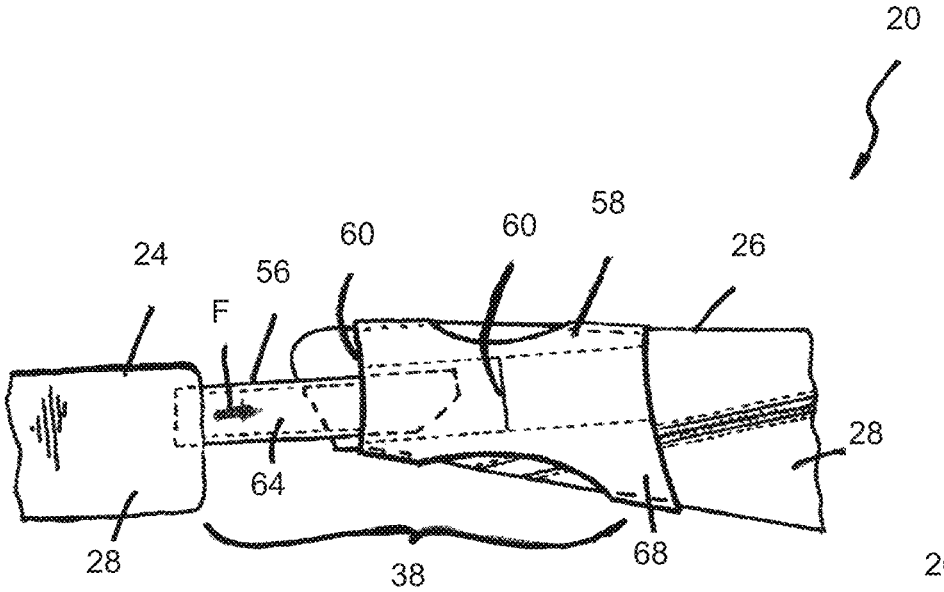
FIG. 7 is another enlarged view of aspects of the throat protector and neck protector of the system of the invention, showing the tuck tab partially inserted into one of the sleeves on the other of the protectors.
Figure 8:
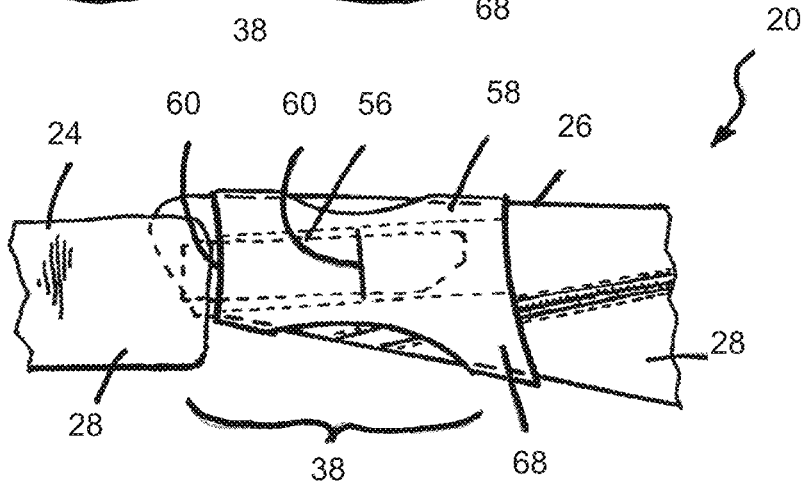
FIG. 8 is another enlarged view of the aspects of the throat protector and neck protector of the system of the invention, showing the tuck tab fully inserted into one of the sleeves on the other of the protectors, to provide a larger neck opening.
Figure 9:
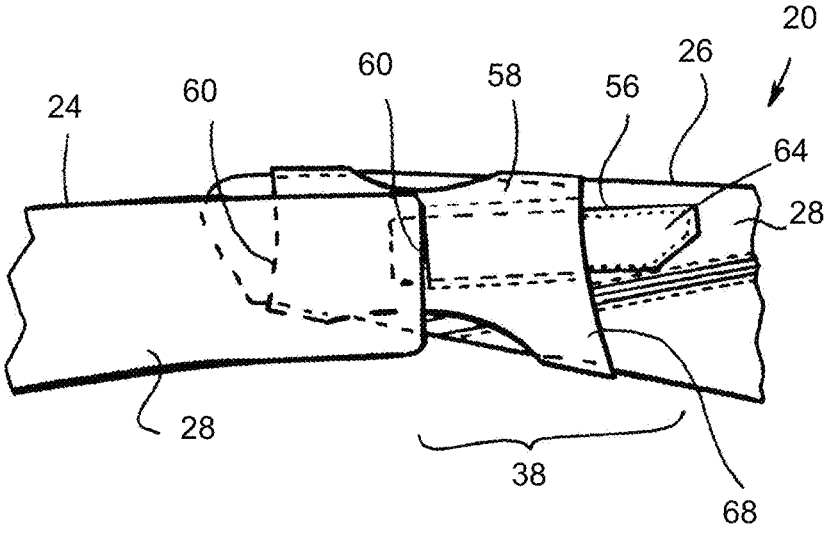
FIG. 9 is still another enlarged view of the aspects of the throat protector and neck protector of the system of the invention, showing the tuck tab fully inserted into another of the sleeves on the other of the protectors, to provide a smaller neck opening.

Referring to FIGS. 1-11, one embodiment of a modular armor supplement apparatus and system 20 constructed and operable according to the teachings of the present invention is shown, configurable to provide armored protection for the throat and neck, upper chest and back, and upper arms and shoulders, usable as a stand alone system, or accompanying an armored vest and/or such as, but not limited to, carrier 22 illustrated in FIG. 5, which overcomes one or more of the disadvantages and shortcomings of known systems as set forth above, including allowing donning and doffing the vest and/or carrier separately of the supplement system and apparatus 20.

System and apparatus 20 utilizes a throat protector 24 and neck protector 26, each configured to carry armor, and which is shaped or shapeable to have a outer convex side 28 and an opposite inner concave side 30, the throat and neck protectors 24, 26 being connectable in generally end to end relation with the concave sides 30 bounding and defining a neck opening 32 having a size and shape for receiving a person's neck, e.g., represented by mannequin neck 34 (FIG. 1) and the convex sides facing outward, providing front, rear and side armored protection for the wearer's throat and neck. The armor components of the protectors can comprise a well know commercially available soft armor such as a woven aramid fiber, and/or a plate armor 36 (FIG. 10), conventionally carried e.g., in zippered compartments in the protectors, used for military, police, and security, as desired or required for a particular application. The system and apparatus 20 includes connecting elements 38 associated with the ends of throat and neck protectors 24, 26, respectively, configured to connect the ends of the throat and neck protectors 24, 26 together in a manner for holding them in place about the person's neck, to prevent release or disconnection under forces anticipated to be exerted thereagainst during normal use, including the weight of the protector 24, 26, and forces exerted by body movements, and which allows adjusting a sectional or diametrical extent of the neck opening, for example, for different neck sizes, and accommodating gear such as helmets and/or radio headphones, microphones, etc.

One or both of the protectors 24, 26 can connect to aspects of a vest or carrier, e.g. vest 22, worn at the same time, and, as a non-limiting example the modular system and apparatus 20 can include armored upper chest and back protectors 40, 42 respectively, connected to the throat and neck protectors 24, 26, respectively, for instance, in a depending manner, e.g. connected via suitable straps or the like. The upper chest and back protectors 40, 42 are preferably additionally connected together by adjustable shoulder straps 44 separate of shoulder straps connecting front and rear sections of an accompanying vest and/or carrier. Still further, the modular system and apparatus 20 can include armored upper arm or deltoid protectors 46, that preferably connect to the system 20 via straps 48 that encircle shoulder straps 44 of that system, to connect to the upper chest, back, throat and neck protectors, and include arm straps 50 for securing about the upper arm.

As an advantage of the modular supplement system 20 of the invention, the shoulder straps 44 of the system are configured to be worn simultaneously with shoulder straps, e.g., shoulder straps 52 of vest 22 (FIG. 5) of an accompanying vest and/or carrier, in a manner allowing the vest and/or carrier to be donned and doffed separately of the supplemental system. Simple fasteners such as hook and loop fasteners 54 can be used to attach the upper chest and/or back protectors 40, 42 to front and/or rear elements of a vest and/or carrier, e.g., vest 22, to allow simple and easy attachment and detachment for donning and doffing the vest and/or carrier.

The components of the modular apparatus and system 20 can be connected using common fastening elements such as, loops, snaps, buttons, and/or hook and loop fasteners 54, as desired or required. Representative examples of connection points include: between the throat and neck protectors 24, 26 and the upper chest and upper back protectors 40, 42; between shoulder straps 44 and the upper chest and upper back protectors 40, 42; and between the deltoid protectors 46 and the shoulder straps 44. Additionally, it is desirable that the deltoid protectors 46 be configured to allow normal arm movements, e.g., fore, aft, up, down, and also rotatably or pivotably relative to the upper chest and back protectors 40, 42 without interference with separate shoulder straps 52 of an accompanying vest and/or carrier, if worn, e.g., vest 22 of FIG. 5. As an additional option for connection of the components of the supplemental armor system 20, quick release mechanisms, such as the slidable locking mechanism disclosed in Buerck et al. PCT Patent Application Serial No. US12/65854, filed Nov. 19, 2012, entitled MODULAR ARMOR SUPPLEMENT APPARATUS AND SYSTEM, the disclosure of which is incorporated herein by reference in its entirety, can be used at any or all of the listed connecting points.

Connecting elements 38 connecting the throat and neck protectors 24, 26 are different and are of a friction type, and can be configured to provide multiple positions to enable variability of the size of neck opening 32 between a maximum value and a minimum value, including optionally infinite positioning between those positions, if desired. The connecting elements 38 can also be quickly and easily connected and disconnected, for fast donning and doffing, independently of a vest and/or carrier, all substantially silently, that is, sufficiently silently to avoid by nearby persons, which may be required under some circumstances, such as when the wearer is concealed or undetected. These capabilities are preferably provided using a tuck tab 56 or tabs 56, which essentially comprise elongate or tongue shaped members on at least one of the ends of at least one of the protectors 24, 26, and a sleeve 58 or sleeves 58 in or adjacent to an end of another of the protectors 24, 26, each sleeve 58 comprising an external slit 60 or slits 60 in connection with an internal cavity 62 or cavities 62, configured for cooperatively receiving and holding the tuck tab 56 at a selectable longitudinal position therein. Each tuck tab 56 is preferably of generally rigid or semi-rigid, collectively referred to herein as "rigid" or "substantially rigid", robust construction and has at least one outer surface 64 of a material having a relatively high friction coefficient, such as, but not limited to, a course woven nylon or pile fabric, non-slip composition, or the like which will frictionally resist longitudinal movement of the tuck tab 56, and provide good wear characteristics. A common ballistic nylon fabric commonly used as covering of combat vests and armor carriers, a coarse pile, other suitable fabric, non-slip coating, or the like, can be used for this purpose.

Figure 10:
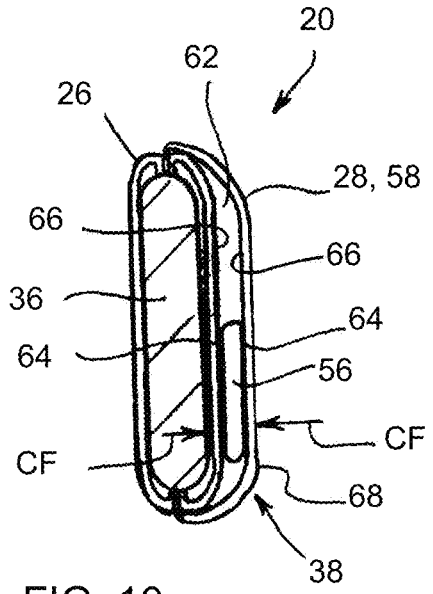
FIG. 10 is sectional view of the other of the throat and neck protectors, showing the frictional engagement of the connecting elements.
Figure 10A:
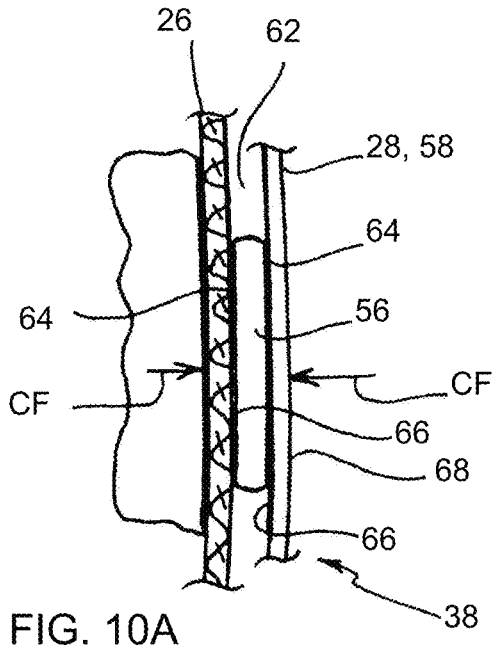
FIG. 10A is a fragmentary sectional view of the protector of FIG. 10, illustrating the frictional engagement.
Figure 11:
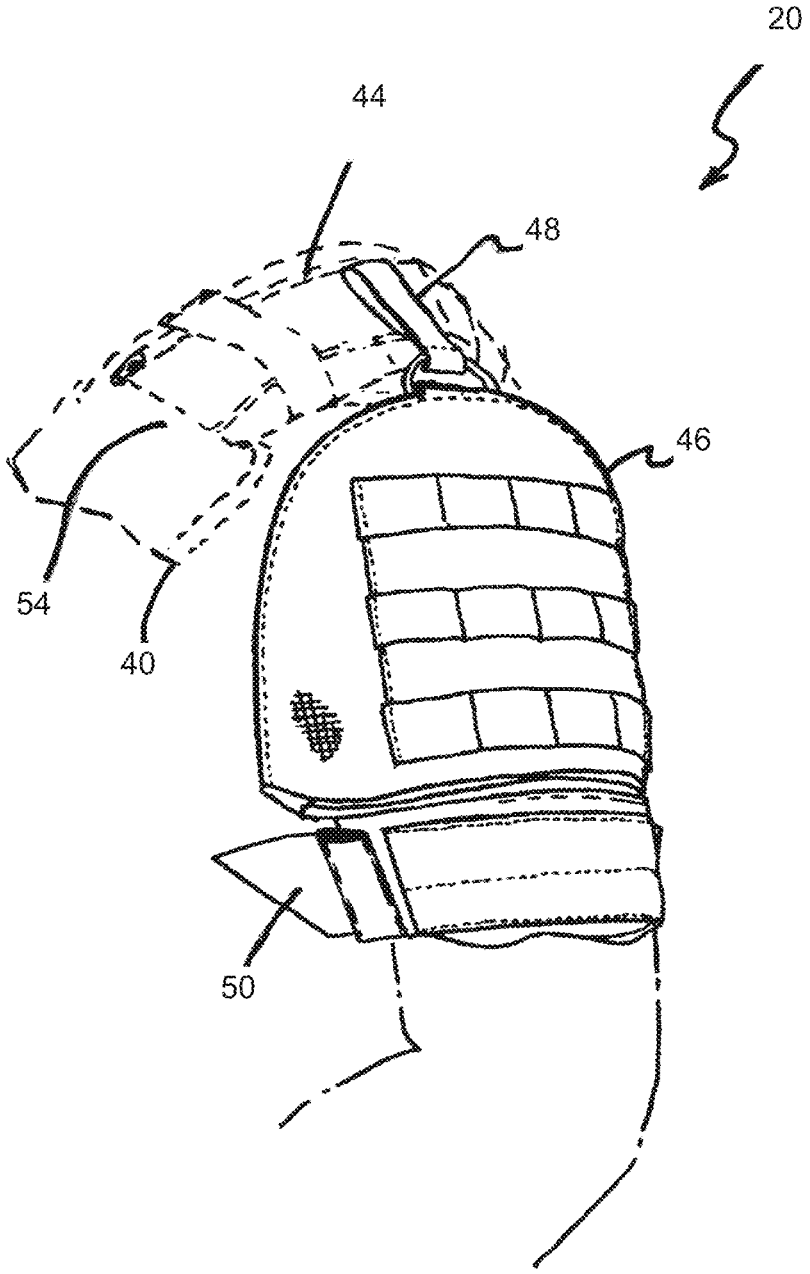
FIG. 11 is a partial perspective view of the embodiment of the apparatus and system of FIG. 1, showing connection of a deltoid protector to a shoulder strap.

Referring in particular to FIGS. 10 and 10A, at least one surface 66 within the internal cavity 62 of the sleeve 58 is positioned to be located in surface to surface engagement with the high friction coefficient tuck tab surface or surfaces 64, and has a corresponding high friction coefficient, e.g., a coarse woven nylon fabric, or the like to facilitate the engagement. The rigidity of the tuck tab 56 is sufficient to allow it to be inserted using a manually exerted longitudinal force, through the slit 60 into the internal cavity 62 to a desired extent without significant bending so as to make insertion unduly difficult, and the receiving cavity 62 is constructed to allow the insertion, as denoted by arrows F in FIGS. 6 and 7, all without generating significant noise. The rigidity should also be sufficient to maintain the protectors 24, 26 in the same relationship as when initially connected or adjusted, under normal usage conditions. The outer fabric coverings of slit or slits 60 and associated internal cavity 62 of the sleeves 58 are additionally preferably configured to normally be substantially taut for exerting a compressive force against the inserted tuck tab and for holding the protectors in position, and also so as to be manually manipulated to open a slight amount in a "fish mouth" shape so as to be enlarged in width (its narrowest dimension) by pinching of the outer fabric covering together to facilitate the insertion, as well as other, e.g., adjusting, movements of the tuck tab 56 without making noise. Then, when the fabric is released its tautness will cause the slit 60 and cavity 62 automatically flatten to exert the compressive force against the tuck tab 56, as denoted by arrow CF in FIGS. 10 and 10A, which combined with the frictional contact, will be sufficient to retain the tuck tab 56 in position for holding the protectors 24, 26 together about a user's neck. By similar manipulations the forces holding the tuck tab 56 can be reduced to allow manually repositioning it in the cavity 62 to change the overall circumferential and diametric size of the joined protectors 24, 26, or to allow removal of the tuck tab 56 for doffing the protectors. In the former regard, the tuck tab and cavity 60 will have sufficient surface area of engagement to provide the necessary frictional holding strength, while allowing sufficient relative longitudinal movement for adjusting. In the latter regard, the portion of the protector 24, 26 including the sleeve 58 will be constructed to have a normal or free state, including when in use, wherein at least one of the opposing surfaces CF bounding the internal cavity of the sleeve will be biased by the tautness toward the flattened condition for exerting the compressive force, in a manner such that combined with the frictional contact between the tuck tab 56 and opposing surface or surfaces 66 within the cavity 62 of the sleeve, the tuck tab 56 will be frictionally held and retained in a selected position.

As noted above, the throat and neck protectors 24, 26 are configured to carry ballistic armored components which can comprise a lighter fabric ballistic protective material, and/or a heavier, rigid plate material, e.g., plate armor 36 (FIG. 10A) covered by one or more outer or covering layers of a fabric or fabrics 68, in either instance this construction having sufficient overall stiffness for at least contributing to the biasing of the inner surface or surfaces 66 of the sleeve 58 bounding the inner cavity 62, toward the flattened condition and against the tuck tab 56 when received therein. As a non-limiting example, the placement of the connecting element 38 on the convex surface 28 of the protector 24, 26 allows the fabric 68 covering that surface to be sufficiently taut or tensioned to exert at least some of the compressive force CF, and the fabric 68 can be capable of being gathered or pinched between a person's fingers with manually applicable force to relieve the tautness sufficiently for inserting, adjusting, or removing the tuck tab 56, but generally not to such an extent as to be loose.

Additionally, in an emergency situation the frictional forces holding the tuck tab 56 can be capable of being manually overcome by exertion of a relatively high longitudinal force (opposite force F) if rapid removal or a break-away capability is required, again, substantially silently.

Protectors 24, 26 can include several of the slits 60 in connection with a single inner cavity 62 of the sleeve 58, as a non-limiting example, located in a linear array corresponding to the longitudinal direction of the associated tuck tab 56, to provide additional options for fitting a wider variety of neck sizes.

Shoulder straps 44 will have a flat sectional shape so as to be capable of underlying the shoulder straps of an accompanying vest and/or carrier, and are flexible in the up and down directions to accommodate body movements and curvature to fit about the shoulder, but stiff in the side (edgewise) directions for holding the deltoid protectors 46 in a desired position heightwise on the arm. A suitable preferred construction of shoulder strap 44 and tuck tab 56 is a strip comprising a laminate of a flat, thin plastics film, and one or more fabric layers. Shoulder straps 44 will additionally include underlying padded portions having ends including connecting elements for connection to the upper chest and back protectors 40, 42, which here comprise hook and loop fasteners 54 connectable to mating fasteners within pockets on the respective protectors 40, 42, preferably in a manner that allows adjustment and which encloses fasteners 54 to provide protection from dirt and dust accumulation.

Figure 12:
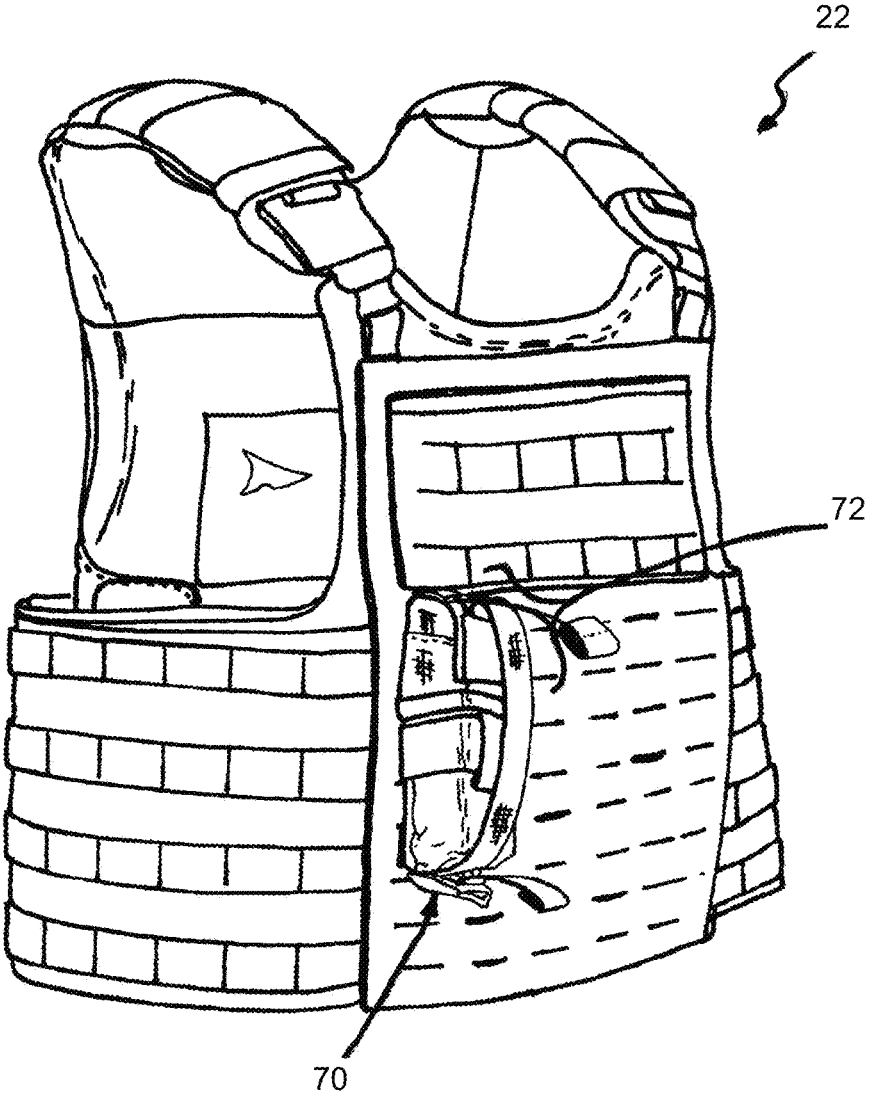
FIG. 12 is a perspective view of a plate carrier having a pouch attached thereto incorporating a silent fastener according to the invention, for securing a cover over an opening of the pouch.

In FIG. 12, a representative carrier or vest 22 is shown, including a pouch 70 conventionally attached thereto, and including a silent fastener 72 constructed and operable according to the teachings of the invention for closing, opening and adjusting pouch 70 for securing an item or items therein, e.g., ammunition magazine or magazines, grenade, battery, etc. As will be explained, silent fastener 72 incorporates aspects of the above described connecting element 38 of the invention, like parts of fastener 72 and connector 38 being identified by like numbers. A silent fastener or fasteners 72 is/are usable in place of various non-silent fasteners, e.g., snaps, hook and loop fasteners such as fasteners 54 referred to above, or connecting elements 38.

Figure 13:
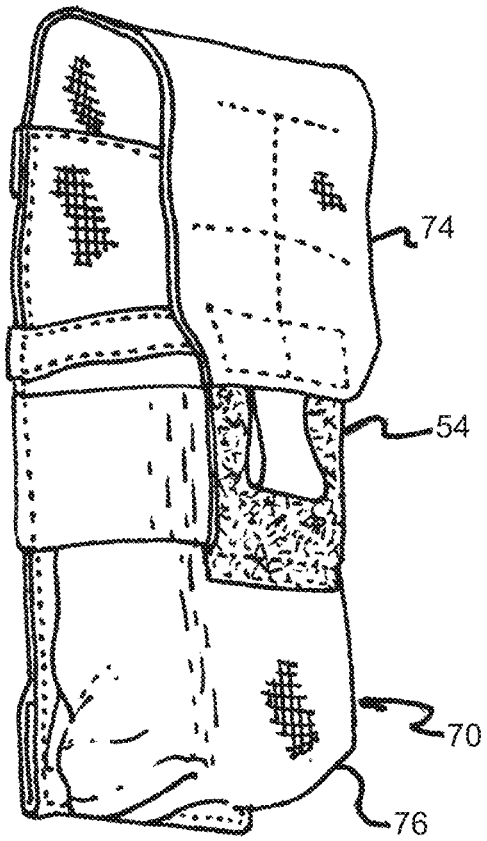
(PRIOR ART) FIG. 13
FIG. 13 is a perspective view of a prior art pouch utilizing a typical hook and loop type fastener securing the pouch cover.

As a representative example of known prior art usages of fasteners for closing and securing pouches, a prior art pouch 70 is shown in FIG. 13, with a hook and loop fastener 54 connecting and securing a cover 74 in covering relation to a body 76 of the pouch. As discussed above, an important shortcoming of this manner of connection and securing is that the hook and loop fastener 54 will emit substantial noise when disconnected, as is well known.

Figure 14:
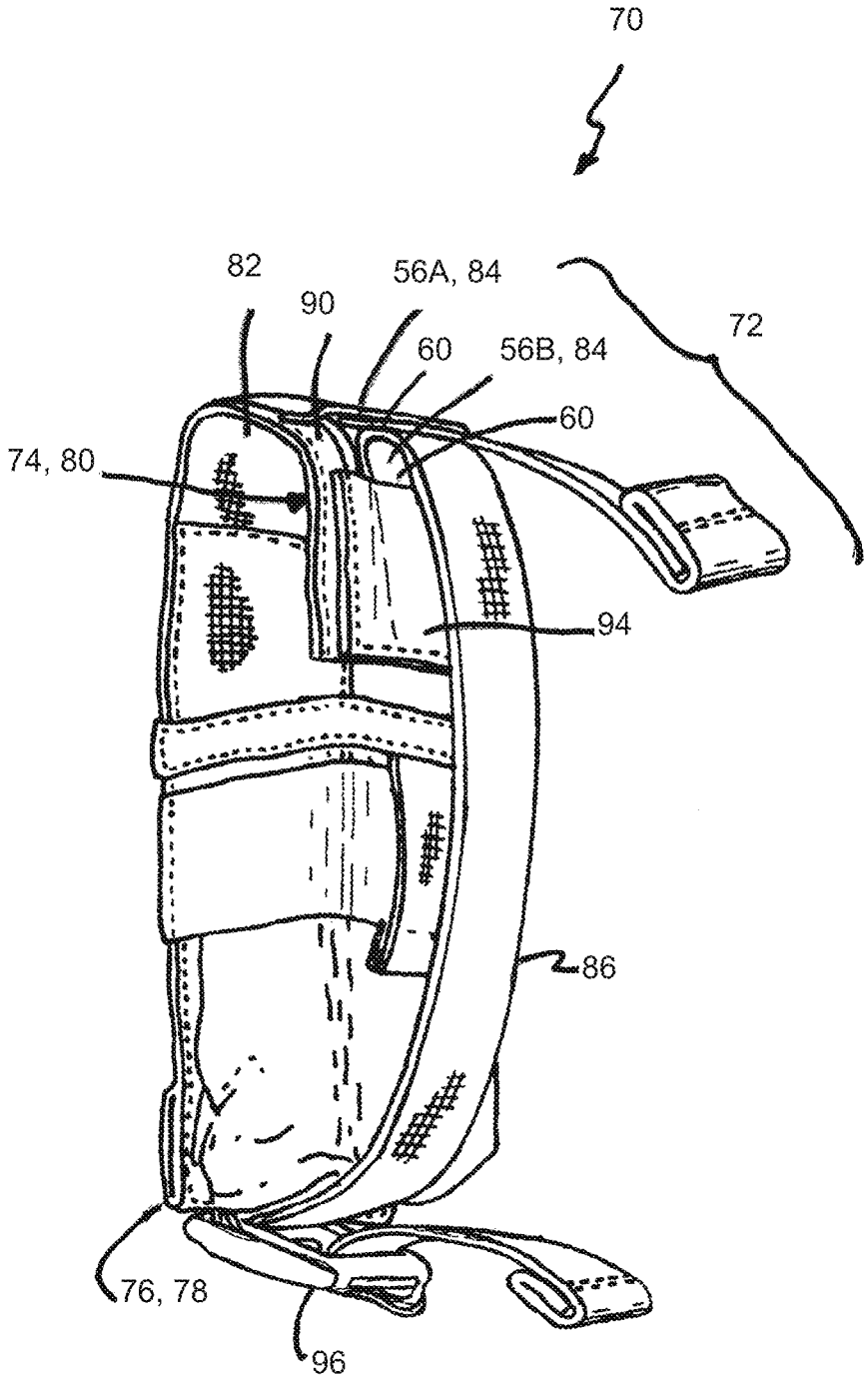
FIG. 14 is an enlarged perspective view of the pouch and silent fastener of FIG. 12.
Figure 15:
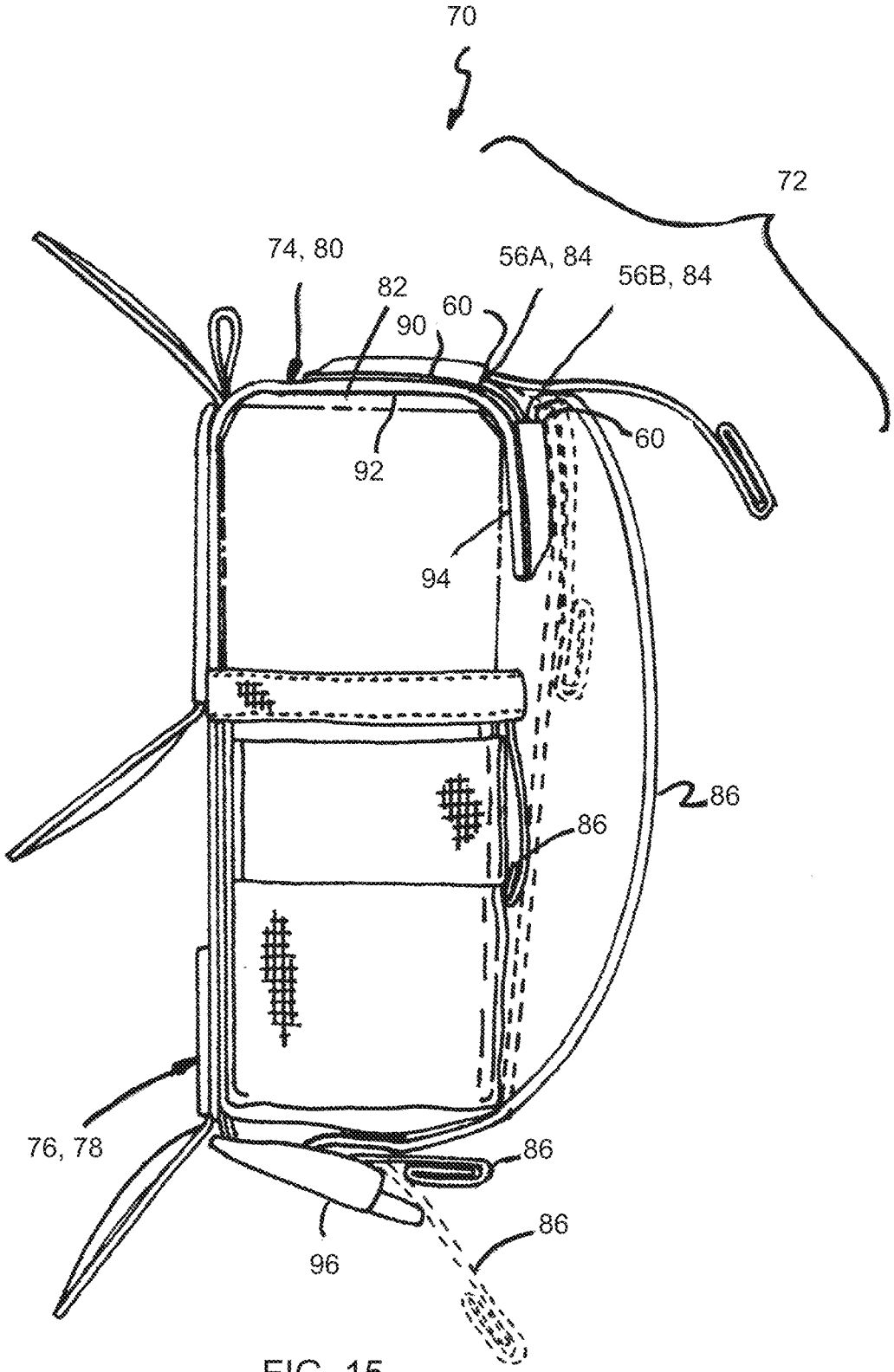
FIG. 15 is an enlarged side view of the pouch and fastener of FIG. 12.
Figure 16:
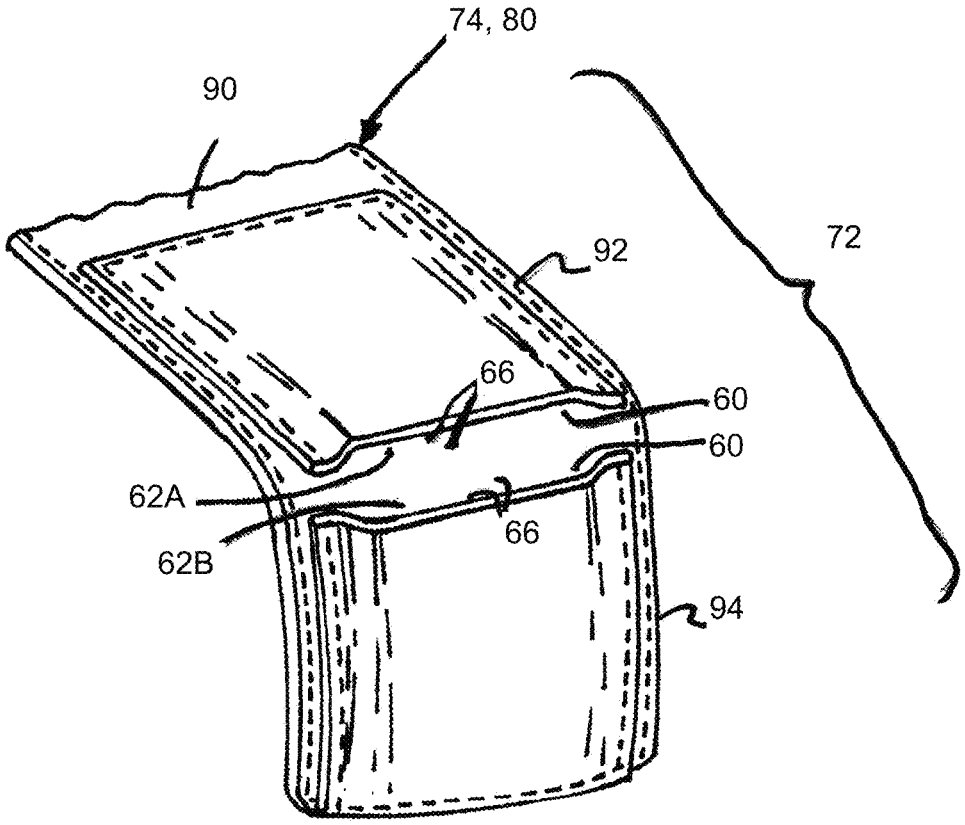
FIG. 16 is an enlarged fragmentary perspective view of the cover of the pouch of FIG. 12, and components of the silent fastener associated therewith.
Figure 16A:
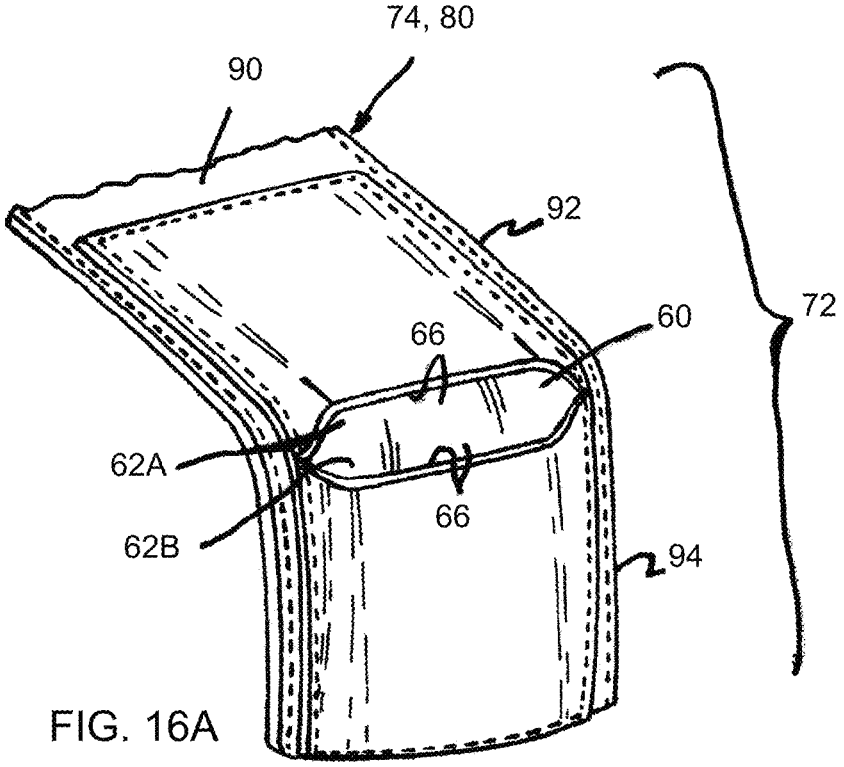
FIG. 16A is another enlarged fragmentary perspective view of the cover, and an alternative embodiment of the fastener component.
Figure 16B:
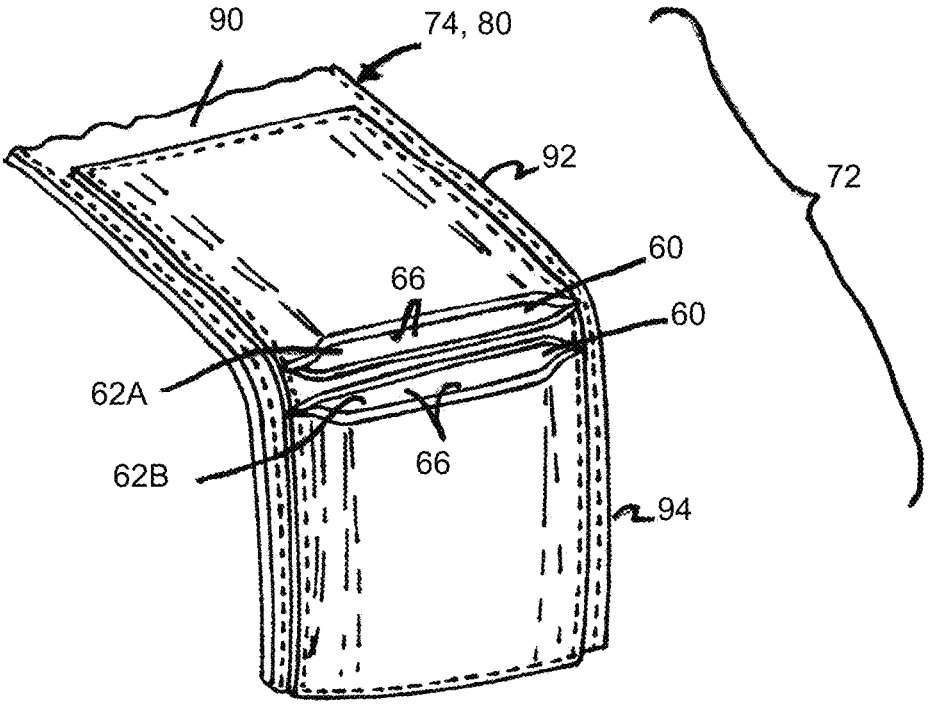
FIG. 16B is another enlarged fragmentary perspective view of the cover, and an alternative embodiment of the fastener component.
Figure 17:
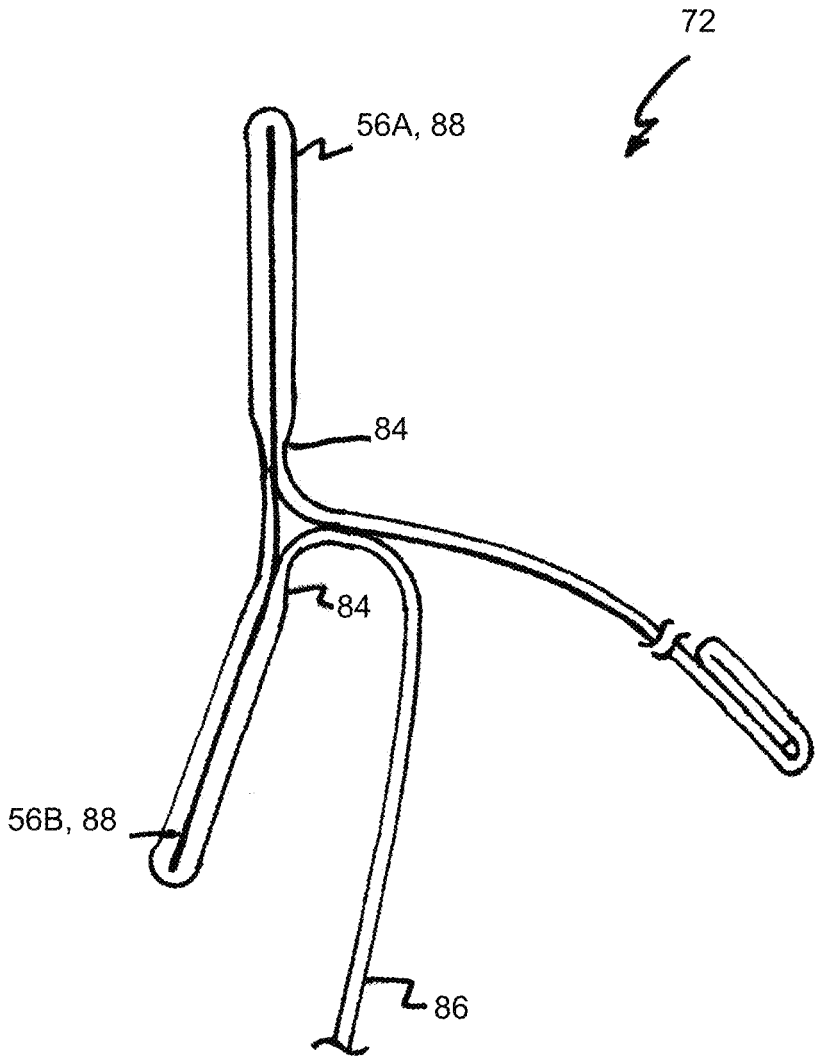
FIG. 17 as an enlarged side view of tuck tab components of the fastener, on the end of a strap of the pouch.

In FIGS. 14 and 15, silent fastener 72 is shown connecting a first element 78 of pouch 70, which the body 76 of the pouch, and a second element 80 which is the cover 74 in covering relation to opening 82 of the pouch for containing and securing an object therein (illustrated in phantom) which could be an ammunition magazine or magazines, a grenade, battery or batteries, as non-limiting examples. Also as a non-limiting example, pouch 70 and silent fastener 72 can be constructed of common materials, such as, but not limited to, a woven fabric such as a nylon, a plastics material, combined material such as an impregnated plastics material such as sold under the Hypalon tradename, and various laminates of well known materials commonly utilized for fabrication of pouches.

Figure 18:
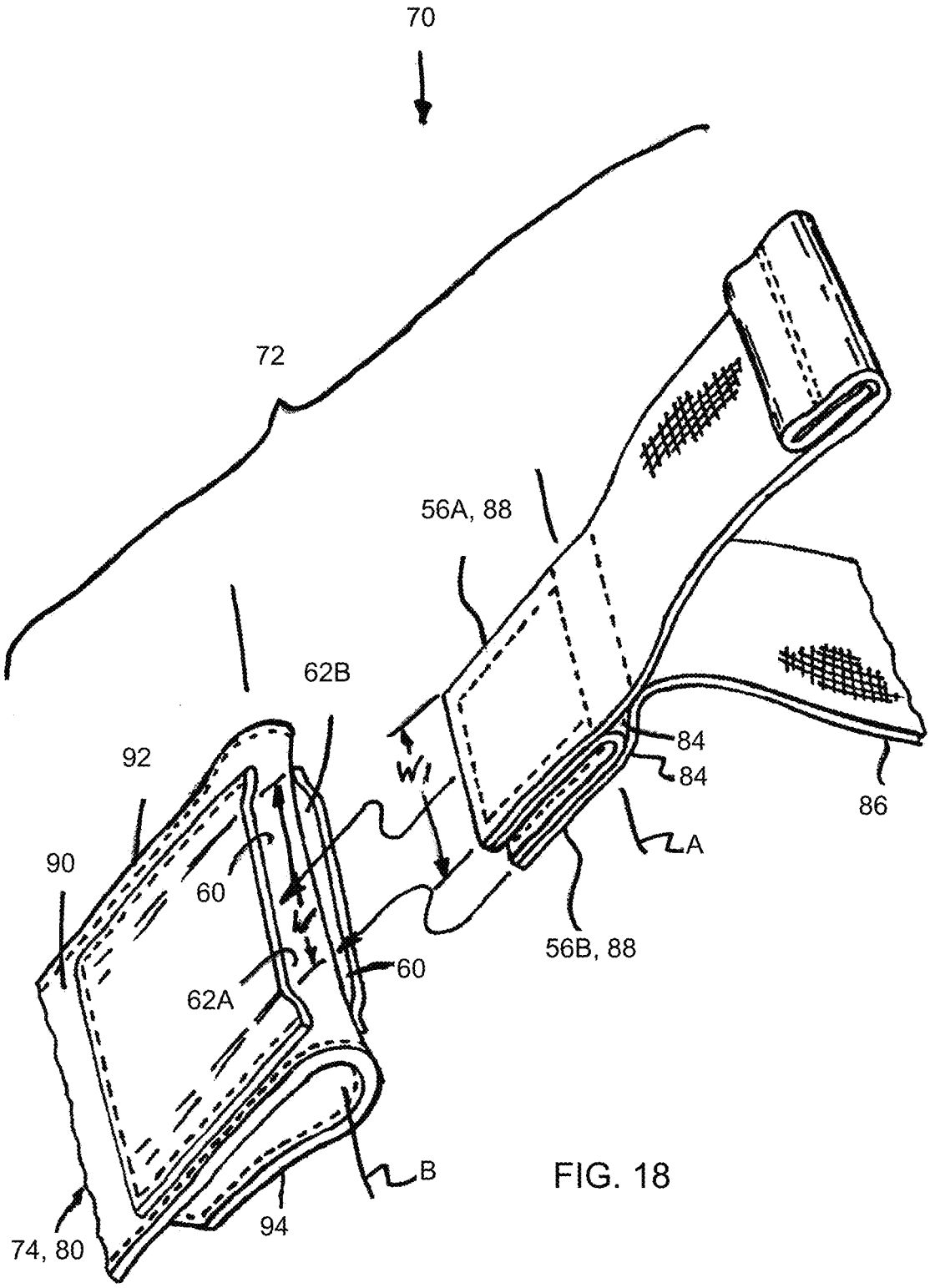
FIG. 18 is an enlarged fragmentary perspective view of the pouch cover, shown in a bent or folded connecting configuration, and associated components of the silent fastener, for insertion of the tuck tabs of FIG. 17 therein.
Figure 19:
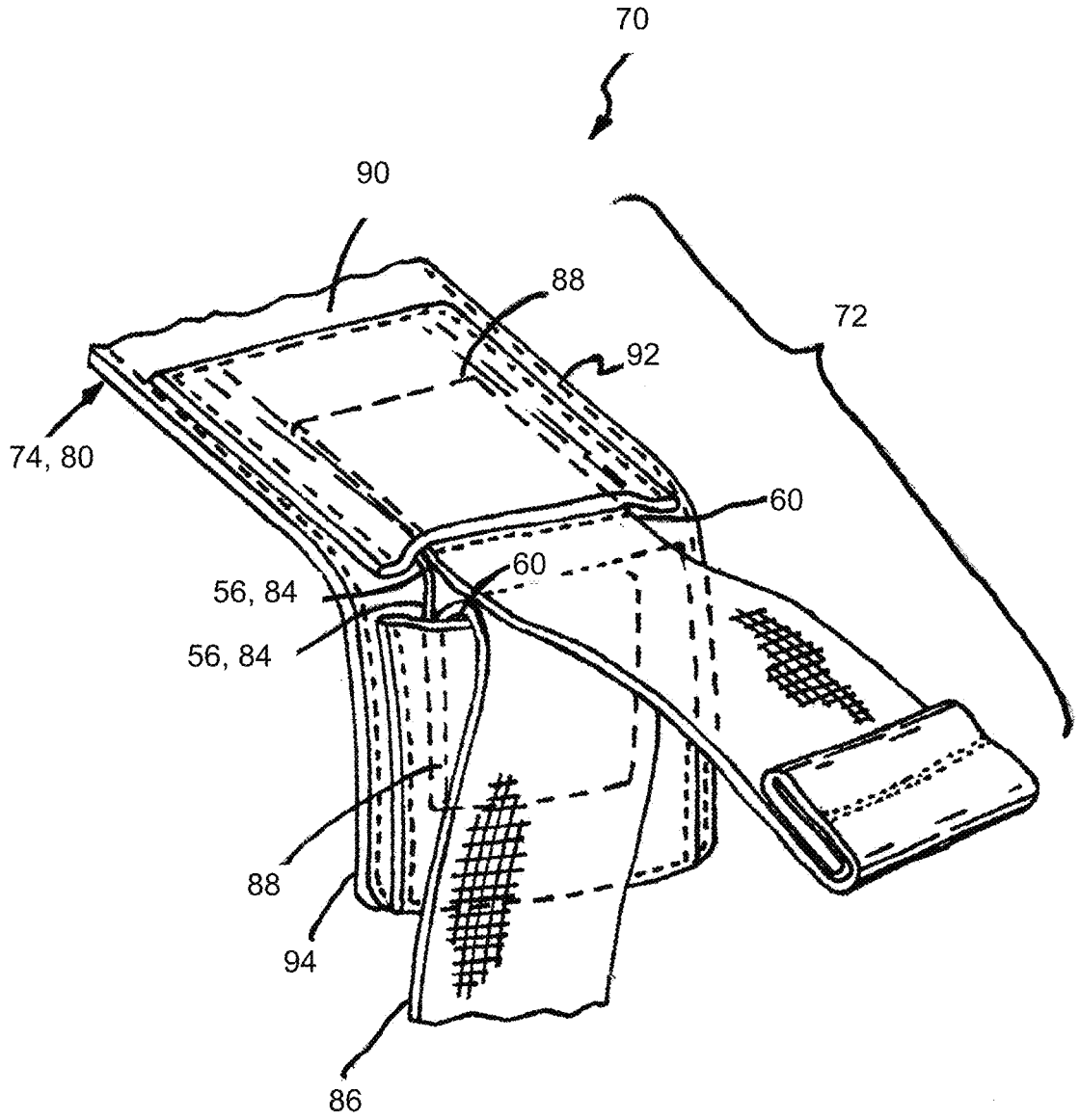
FIG. 19 is an enlarged fragmentary perspective view of the pouch cover, in a less bent or folded operational configuration, for securing the tuck tabs of FIG. 17.
Figure 20:
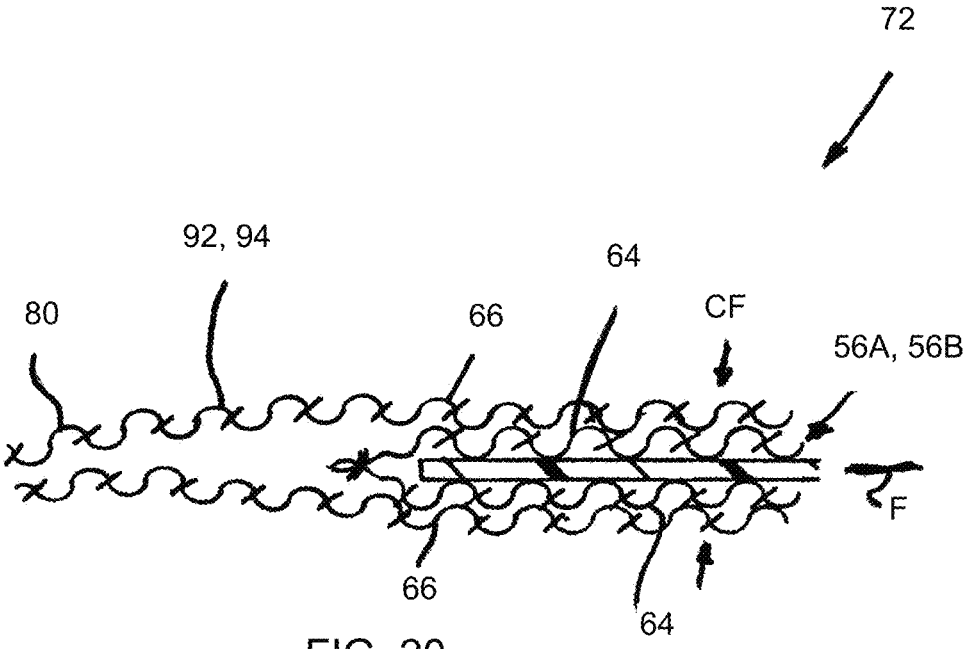
FIG. 20 is a sectional view of a tuck tab of FIG. 17.

Referring also to FIGS. 16, 16A, 16B, 17, 18, 19, and 20, silent fastener 72 here includes a generally rigid, generally flat, first tuck tab 56A, and a second tuck tab 56B, each having a connected end 84 flexibly connected to the first element 78 (body 76), here by a strap or length of webbing 86 connected to a lower end of element 78. Each tuck tab 56A and 56B additionally has a free end 88 opposite connected end 84. Silent fastener 72 includes at least one slit 60 disposed on an outer surface 90 of second element 80 (cover 74), three alternative embodiments being shown as non-limiting examples, the slit or slits 60 having a width W (measured longitudinally along the slit) at least marginally larger than a width W1 of tuck tabs 56 individually, as shown in FIG. 18, so as to be capable of slidably receiving the tuck tab. The slit or slits 60 connect to internal cavities on second element 80, here a cavity 62A on one side of the slit or slits 60, and a cavity 62B on an opposite side, the cavities 62A, 62B being bounded and defined by opposing internal surfaces 66, within a first portion 92 of second element 80, and within a second portion 94, respectively. The opposing internal surfaces 66 of second element 80 and outer surfaces 64 of tuck tabs 56A and 56B are configured to substantially silently engage and resist relative sliding movement therebetween when disposed in surface to surface relation, as illustrated in FIG. 20, and as explained above and shown in FIGS. 10 and 10A in regard to connecting elements 38.

Connected ends 84 of tuck tabs 56A and 56B are each flexibly (also meaning foldably and bendably) connected in generally parallel relation in a manner to allow substantially silently manually flexing generally about an axis A (FIG. 18) to position the tuck tabs to extend generally parallel in one direction, about as depicted in FIG. 18 (which is also inclusive of orientations at a small acute angle); and alternatively, so as to extend in generally opposite directions (inclusive of relatively large angular orientations as depicted in FIGS. 14, 15, 17, and 19). In concert with this capability, second element 80 has an operational configuration wherein the first portion 92 and the second portion 94 thereof will extend in the generally opposite directions, about as depicted in FIGS. 14, 15, 16, 16A, 16B, and 19; second element 80 being substantially silently manually bendable or foldable generally proximate to the at least one slit 60, e.g., generally along an axis B in FIG. 18, to a connecting configuration wherein first portion 92 and second portion 94 extend generally in the one direction, such that tuck tabs 56A and 56B can be inserted through the at least one slit 60 into internal cavities 62, respectively, and such that when second element 80 is returned to the operational configuration with the tuck tabs 56A, 56B located in internal cavities 62 the tuck tabs will extend in the generally opposite directions, and frictionally engage the internal surfaces 66 so as to be retained in the cavities thereby to connect the first and second elements 78, 80 together.

First and second portions 92 and 94 of the second element 80 are configured such that internal surfaces 66 will frictionally engage at least one of the outer surfaces 64 of the respective tuck tabs 56A and 56B, and preferably both, and further will preferably exert compressive forces CF thereagainst in essentially a similar manner as described above in regard to connecting elements 38, for retaining the tuck tabs and connecting the first and second elements 78, 80, together.

Again, the rigidity of tuck tabs 56A, 56B is sufficient to allow them to be fully inserted using a manually exerted longitudinal force F, through the slit 60 into the internal cavity 62A or 62B without significant bending so as to make insertion unduly difficult, without generating significant noise. The rigidity should also be sufficient to maintain the tuck tabs in the cavities under anticipated loading conditions, which, for the illustrated non-limiting application as a closure for a pouch, is anticipated to be less than that required for retaining an armored throat protector in place. To achieve the required holding strength, the outer fabric coverings of cavities 62A and 62B are preferably of a robust fabric such as a nylon webbing material, ballistic nylon, or the like, and should be capable of adequate tautness for exerting force CF with the tuck tab 56A or 56B received in the cavity, but not so taut as to prevent insertion of the tab. It may also be configured so as to facilitate insertion and adjustment by opening in a "fish mouth" shape so as to be enlarged in width (its narrowest dimension) by pinching, without making noise. Then, when the fabric is released its tautness will cause the slit 60 and cavity 62A or 62B to automatically flatten to exert the compressive force against the tuck tab 56A or 56B. By similar manipulations the forces holding the tuck tab 56A or 56B can be reduced to allow manually repositioning it in the cavity 62A or 62B for adjusting or removing the tuck tab 56. For rapid or emergency disconnection, a user can grasp webbing 86 and pull directly outwardly from surface 90 of cover 74, with sufficient force to orient tuck tabs 56A and 56B in the same direction to release from the cover, still relatively silently.

As an additional holding and securing feature, it can be observed in FIGS. 14 and 15 that strap or webbing 86 connecting the tuck tab 56B can include a tensioner 96, which can comprise, but is not limited to, a commercially available webbing tensioner, through which the strap or webbing 86 is weaved, such that by pulling the end of the webbing 86, the webbing can be shortened and tensioned as denoted in dotted lines in FIG. 15. This is preferably used to also effect the bending the opposite end of webbing 86 into closely overlaying relation to second portion 94 of the cover 74 and tuck tab 56B retained therein, such that that tuck tab and associated end of webbing 86 are in a "hairpin" shape, which combined with it stiffness or rigidity, and the friction, to make it difficult for tuck tab 56B to be removed from the associated cavity 62B, further strengthening the connection. The tension can also be adjusted to more or less snuggly hold an object in pouch 70, as desired.

Referring to FIGS. 21, 22, 23, and 24, a pouch 70 is shown including another silent fastener 98 constructed and operable according to the teachings of the invention, like parts of silent fastener 98 and silent fastener 72 and connecting elements 38 being identified by like numbers. As described above, pouch 70 has a cover 74 positionable in covering relation to an opening of a body 76. A tuck tab 56 is connected via a strap or webbing 86 to body 76, and a slit 60 extends through an outer surface 90 of cover 74, so as to form a sleeve for receiving the tuck tab. Silent fastener 98 differs from silent fastener 72 in that the tuck tab 56 is passed completely through the slit 60 so as to emerge from the opposite side, to interferingly and interlockingly engage an associated edge of outer surface 90, so as to be retained thereby, for holding cover 74 in closing relation to the pouch opening. Associated with slit 60 is a pull tab 100 graspable to pull outer surface 90 outwardly to open slit 60 to facilitate insertion and removal of the tuck tab, both of which can be done substantially silently as should be apparent.

As variants, the portion of outer surface 90 including slit 60 can comprise a length of webbing material as shown, sewn or otherwise attached at its opposite ends to a larger section of fabric comprising cover 74. Alternatively, slit 60 can be laser or otherwise cut through a larger section of fabric comprising the cover 74.

Figure 21:
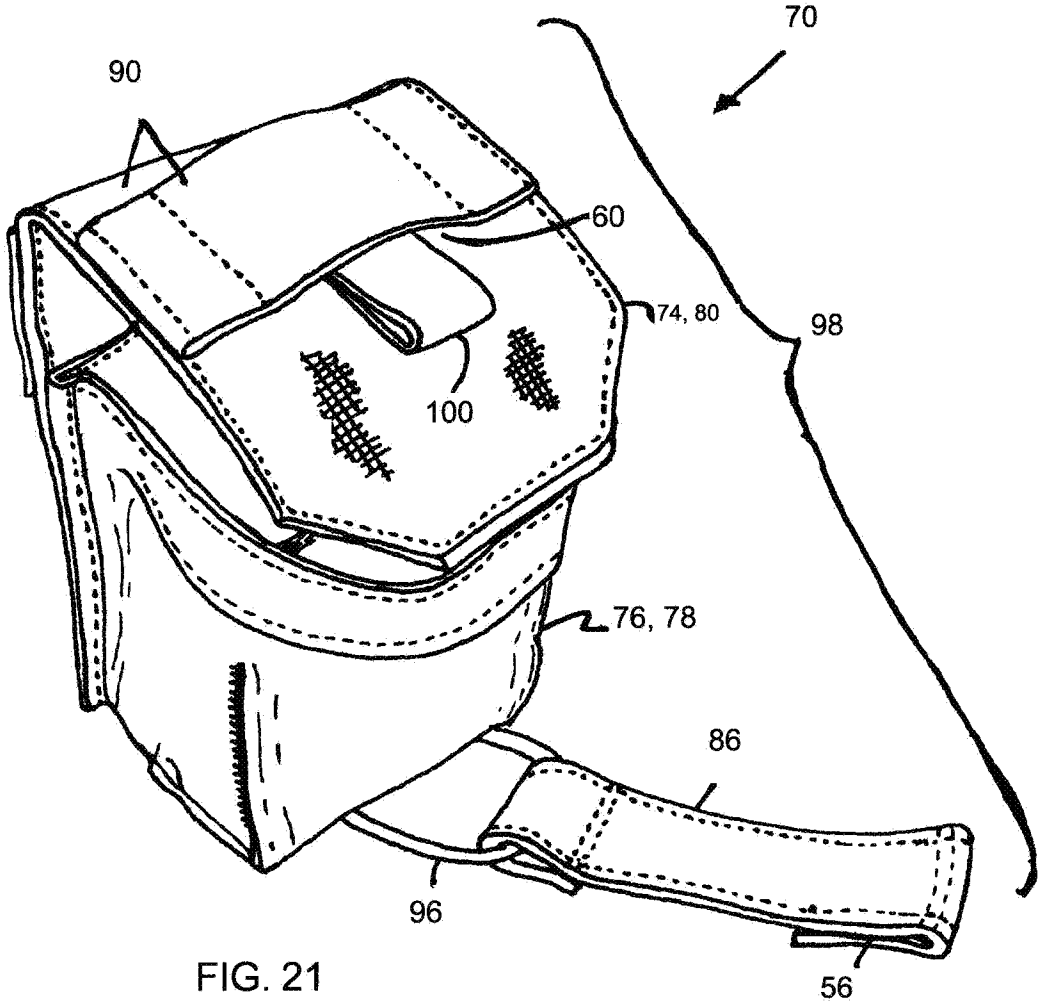
FIG. 21 is a perspective view of another representative pouch incorporating another embodiment of a silent fastener according to the invention, for securing a cover over an opening of the pouch.
Figure 22:
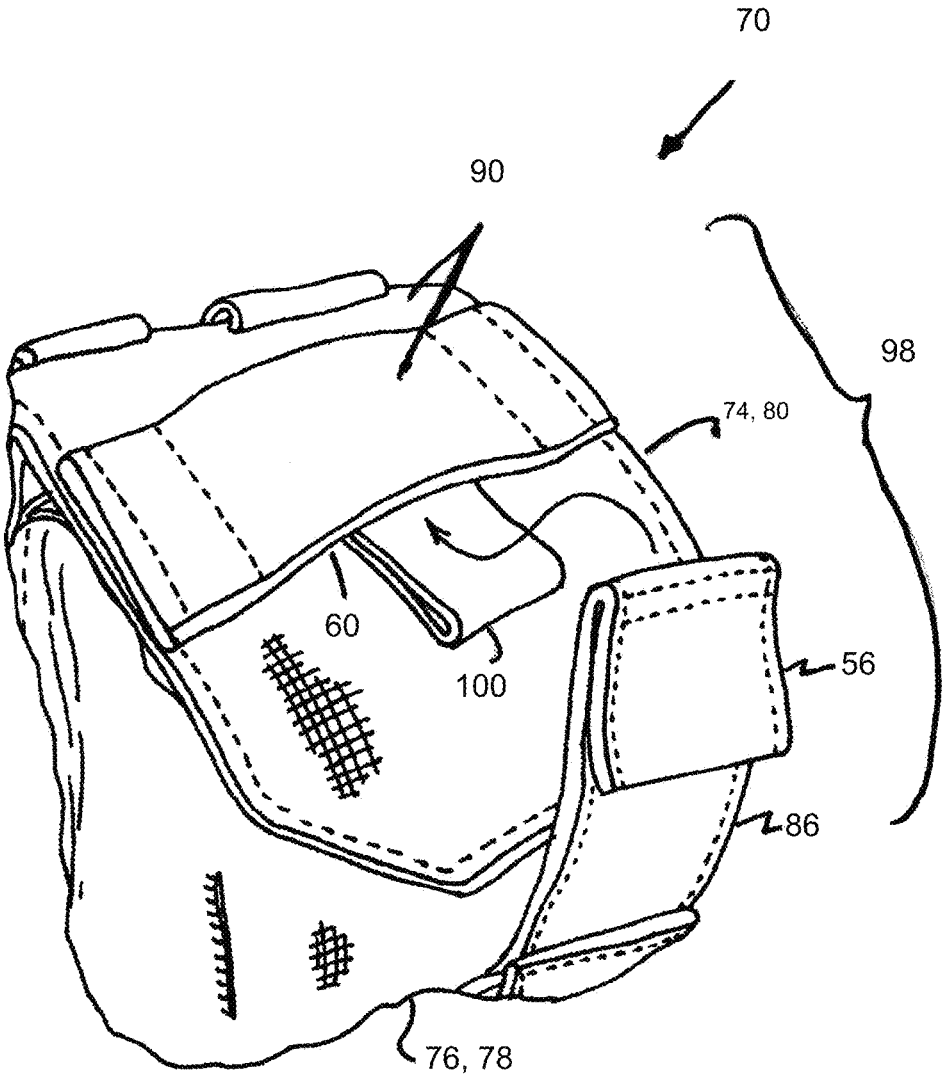
FIG. 22 is a fragmentary perspective view of the pouch of FIG. 21, illustrating a step of connecting the fastener.
Figure 23:
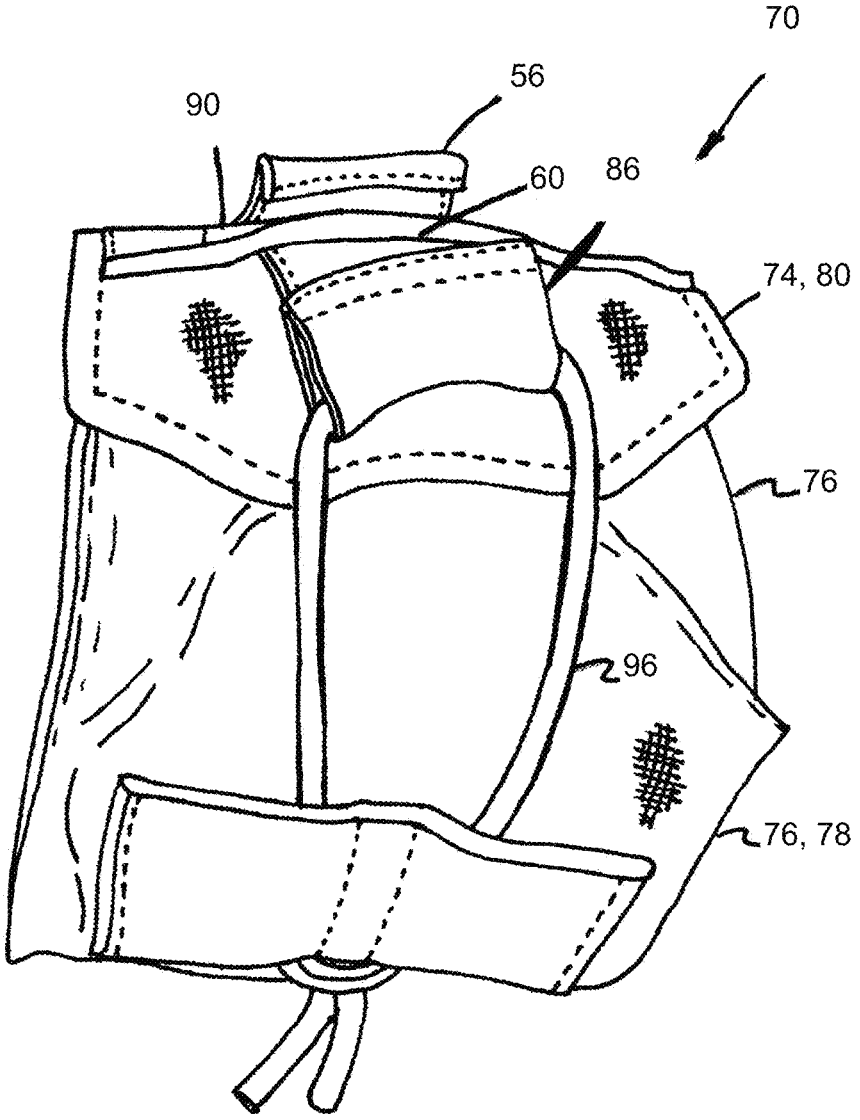
FIG. 23 is a bottom view of the pouch of FIG. 21, illustrating aspects of the fastener.
Figure 24:
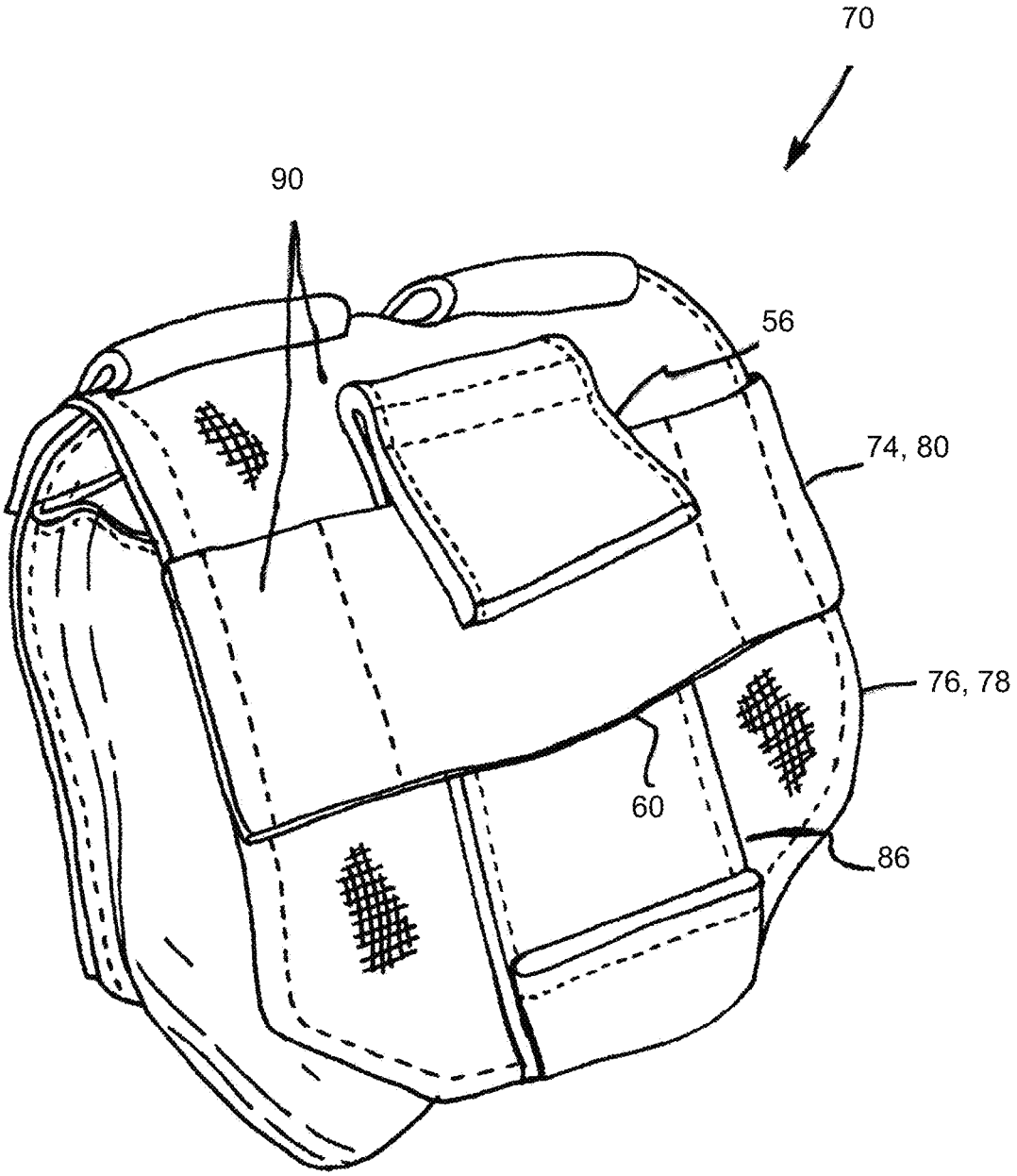
FIG. 24 is another perspective view of the pouch, illustrating the fastener connected.

Silent fastener 98 additionally includes a tensioner 96 as shown in FIGS. 21 and 23, configured and operable to tension strap or webbing 86 to hold tuck tab 56 against the edge of outer surface 90, to prevent inadvertent disconnection, and provide a manner of adjusting the tautness of cover 74 for more or less snuggly hold the contained object in pouch 70. Here, tensioner 96 comprises a loop of shock cord, that can be tied in a knot or cut or adjusted to a required length to create the desired tension. Either tensioner shown, or another tensioner configuration can be used with either fastener 72 or 98, as desired. Additionally, it should be noted that both tensioner constructions shown can be adjusted silently in accordance with the objectives for the invention.

As an additional note, each of the silent fasteners 72 and 98 can be connected, disconnected, and adjusted, substantially silently, by feel, and while wearing gloves.

In light of all the foregoing, it should thus be apparent to those skilled in the art that there has been shown and described several embodiments of a novel modular armor supplement apparatus and system and silent fastener. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

The invention claimed is:

1. A ballistic neck and throat protecting apparatus, comprising:

a ballistic throat protector having a first tuck tab having a connected end, a free end opposite the connected end, and a width, and oppositely facing outer surfaces extending between the connected end and the free end, the connected end of the first tuck tab being connected to the ballistic throat protector adjacent to a first end thereof by a foldable or bendable element to allow positioning a predetermined region of the ballistic throat protector in overlaying relation to the first tuck tab with the first tuck tab extending toward a second end of the ballistic throat protector;

a ballistic neck protector comprising an outer layer and an internal surface bounding a flat internal cavity;

a flat second tuck tab having a connected end, a free end opposite the connected end thereof, a width, and oppositely facing outer surfaces extending between the connected end and the free end thereof, the connected end of the second tuck tab being foldably or bendably connected to the foldable or bendable element, the second tuck tab extending in a direction opposite the first tuck tab;

the outer layer of the ballistic neck protector comprising at least one slit having a width just wider than the width of the first tuck tab and the second tuck tab and connecting to the flat internal cavity, a first portion of the flat internal cavity extending from the at least one slit toward the second end of the ballistic throat protector and being sufficiently large to receive the first tuck tab, and a second portion of the flat internal cavity extending from the at least one slit in the direction opposite the first tuck tab and being sufficiently large to receive the second tuck tab; and the first tuck tab extending through the at least one slit into the first portion of the flat internal cavity toward the second end of the ballistic throat protector with the outer layer and internal surface bounding the flat internal cavity in frictional contact with the outer surfaces of the first tuck tab, and the foldable or bendable element folded or bent to position the first tuck tab such that the predetermined region of the ballistic throat protector overlays the first tuck tab and the outer layer exerts a compressive force thereagainst, and the second tuck tab extends through the at least one slit into the second portion of the flat internal cavity.

2. The ballistic neck and throat protecting apparatus of claim 1, wherein the foldable or bendable element comprises a strap.

3. The ballistic neck and throat protecting apparatus of claim 2, comprising a tensioner to longitudinally tension the strap.

4. The ballistic neck and throat protecting apparatus of claim 1, wherein the outer layer and an internal surface bounding the flat internal cavity comprise a coarse material to frictionally engage the outer surfaces of the first tuck tab.

5. The ballistic neck and throat protecting apparatus of claim 1, wherein at least the first tuck tab comprises at least one layer of a fabric material and a layer of a rigid rubber or plastics material.

6. The silent fastener of claim 1, wherein the at least one slit comprises two slits.

7. The silent fastener of claim 1, wherein the at least one slit comprises a single slit.

8. A silent fastener for connecting a first element to a second element, comprising:

a flat first tuck tab having a connected end, a free end opposite the connected end, the first tuck tab having a width, and oppositely facing outer surfaces extending between the connected end and the free end, the connected end of the first tuck tab being connected to the first element adjacent to a first end thereof by a foldable or bendable element to allow positioning a predetermined region of the first element in overlaying relation to the first tuck tab with the first tuck tab extending toward a second end of the first element;

the second element comprising an outer layer and an internal surface bounding a flat internal cavity;

a flat second tuck tab having a connected end, a free end opposite the connected end thereof, a width, and oppositely facing outer surfaces extending between the connected end and the free end thereof, the connected end of the second tuck tab being foldably or bendably connected to the foldable or bendable element, the first tuck tab and the second tuck tab extending in opposite directions;

the outer layer of the second element comprising at least one slit having a width just wider than the width of the first tuck tab and the second tuck tab and connecting to the flat internal cavity, a first portion of the flat internal cavity extending from the at least one slit toward the second end of the first element and being sufficiently large to receive the first tuck tab, and a second portion of the flat internal cavity extending from the at least one slit away from the second end of the first element and being sufficiently large to receive the second tuck tab; and the first tuck tab extending through the at least one slit into the first portion of the flat internal cavity toward the second end of the first element with the outer layer and internal surface bounding the flat internal cavity in frictional contact with the outer surfaces of the first tuck tab, and the foldable or bendable element folded or bent to position the first tuck tab such that the predetermined region of the first element overlays the first tuck tab and the outer layer exerts a compressive force thereagainst, and the second tuck tab extends through the at least one slit into the second portion of the flat internal cavity.

9. The silent fastener of claim 8, wherein the foldable or bendable element comprises a strap.

10. The silent fastener of claim 8, wherein the tuck tabs comprise at least one layer of a fabric material and a layer of a rigid rubber or plastics material.

11. The silent fastener of claim 8, wherein the at least one slit of the outer layer of the second element is laser cut.

12. The silent fastener of claim 8, wherein the first element comprises a ballistic throat protector and the second element comprises a ballistic neck protector.

13. The silent fastener of claim 8 wherein the first element comprises one end of a pouch and the second element comprises an opposite end of the pouch.

14. The silent fastener of claim 8, wherein the at least one slit comprises two slits.

15. The silent fastener of claim 8, wherein the at least one slit comprises a single slit.

16. A silent fastener for connecting a first element to a second element, comprising:

a flat first tuck tab having a connected end, a free end opposite the connected end, the first tuck tab having a width, and oppositely facing outer surfaces extending between the connected end and the free end, the connected end of the first tuck tab being connected to the first element adjacent to a first end thereof by a strap to allow positioning a predetermined region of the first element in overlaying relation to the first tuck tab with the first tuck tab extending toward a second end of the first element;

the second element comprising an outer layer and an internal surface bounding a flat internal cavity;

a flat second tuck tab having a connected end, a free end opposite the connected end thereof, a width, and oppositely facing outer surfaces extending between the connected end and the free end thereof, the connected end of the second tuck tab connected to the strap, the first tuck tab and the second tuck tab extending in opposite directions;

the outer layer of the second element comprising at least one slit having a width just wider than the width of the first tuck tab and the second tuck tab and connecting to the flat internal cavity, a first portion of the flat internal cavity extending from the at least one slit toward the second end of the first element and being sufficiently large to receive the first tuck tab, and a second portion of the flat internal cavity extending from the at least one slit away from the second end of the first element and being sufficiently large to receive the second tuck tab; and the first tuck tab extending through the at least one slit into the first portion of the flat internal cavity toward the second end of the first element with the outer layer and internal surface bounding the flat internal cavity in frictional contact with the outer surfaces of the first tuck tab, and the strap folded or bent to position the first tuck tab such that the predetermined region of the first element overlays the first tuck tab and the outer layer exerts a compressive force thereagainst, and the second tuck tab extends through the at least one slit into the second portion of the flat internal cavity.

17. The silent fastener of claim 16, comprising a tensioner connected to the strap, operable to longitudinally tension the strap.

18. The silent fastener of claim 16, wherein the at least one slit comprises a single slit.

19. The silent fastener of claim 16, wherein the at least one slit comprises at least two slits.

20. The silent fastener of claim 16, wherein the first element comprises a ballistic throat protector and the second element comprises a ballistic neck protector.

* * * * *